US006413924B2

(12) United States Patent
Willey

(10) Patent No.: US 6,413,924 B2
(45) **Date of Patent: *Jul. 2, 2002**

(54) PHOTOBLEACHING COMPOSITIONS COMPRISING MIXED METALLOCYANINES

(75) Inventor: Alan David Willey, Cincinnati, OH (US)

(73) Assignee: Case Western Reserve University, Cleveland, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/355,153

(22) PCT Filed: Jan. 22, 1998

(86) PCT No.: PCT/US98/00226

§ 371 (c)(1),
(2), (4) Date: Jul. 23, 1999

(87) PCT Pub. No.: WO98/32826

PCT Pub. Date: Jul. 30, 1998

Related U.S. Application Data

(60) Provisional application No. 60/033,549, filed on Jan. 24, 1997.

(51) Int. Cl.[7] ..... C11D 7/22
(52) U.S. Cl. ..... 510/301
(58) Field of Search ..... 510/367, 301

(56) References Cited

U.S. PATENT DOCUMENTS

| | | | | |
|---|---|---|---|---|
| 3,094,536 A | | 6/1963 | Kenney et al. | 260/314.5 |
| 3,927,967 A | | 12/1975 | Speakman | 8/103 |
| 4,033,718 A | | 7/1977 | Holcombe et al. | 8/103 |
| 4,166,718 A | * | 9/1979 | Reinert et al. | 8/111 |
| 4,240,920 A | | 12/1980 | de Luque | 252/99 |
| 4,255,273 A | | 3/1981 | Sakkab | 252/102 |
| 4,256,597 A | | 3/1981 | Sakkab | 252/99 |
| 4,318,883 A | | 3/1982 | Polony et al. | 422/22 |
| 4,368,053 A | | 1/1983 | Eckhardt et al. | 8/102 |
| 4,400,173 A | * | 8/1983 | Beavan | 8/107 |
| 4,497,741 A | | 2/1985 | Hölzle et al. | 260/245.77 |
| 4,524,014 A | * | 6/1985 | Finch et al. | 252/188.1 |
| 4,648,992 A | * | 3/1987 | Graf et al. | 540/124 |
| 5,482,514 A | * | 1/1996 | Von Raven | 8/110 |
| 5,679,661 A | * | 10/1997 | Willey | 514/63 |
| 5,916,481 A | * | 6/1999 | Willey | 252/186.21 |

FOREIGN PATENT DOCUMENTS

| | | |
|---|---|---|
| EP | 0 285965 | 10/1988 |
| EP | 0 381211 | 8/1990 |
| EP | 0 484027 | 5/1992 |
| GB | 1372035 | 10/1974 |
| GB | 1408144 | 1/1975 |
| GB | 2159516 | 12/1985 |
| GB | 2313122 A * | 11/1997 |
| JP | 6-73397 | 3/1994 |
| WO | WO 91/18006 | 11/1991 |
| WO | WO 97/05202 * | 11/1997 |

OTHER PUBLICATIONS

Brasseur, N., et al., "Synthesis and Photodynamic Activities of Silicon 2,3–Naphthalocyanine Derivatives", J. Med. Chem., vol. 37, p. 415–420 (1994).

Cook, M.J. et al., "Octa–alkoxy Phthalocyanine and Naphthalocyanine Dertivatives: Dyes with Q–band Absortion in the Far Red or Near Infrared" J. Chem. Soc., Perkin Trans., vol. I., p. 2453–2458 (1988).

Esposito, J.N. et al., "The Synthesis and Physical Properties of Some Organo– and Organosiloxysilicon Phthalocyanines", Inorg. Chem., vol. 5, No. 11, pp. 1979–1984 (Nov. 1966).

Ford, W.E. et al., "Synthesis and Photochemical Properties of Aluminum, Gallium, Silicon, and Tin Naphthalocyanines", Inorg. Chem., vol. 31, p. 3371–3377 (1992).

Hayashida, S., et al., "Effect of Axial Substituents on the Aggregate of Silicon Naphthalocyanine in the Vacuum Deposited Thin Films", Chem. Lett., pp. 2137–2140 (1990).

Joyner, R.D. et al, "Phthalocyaninosilicon Compounds", Inorg. Chem., vol. 1, No. 2, pp. 236–238 (May 1962).

Kroenke, W.E. et al., "The Infrared Spectra of Some Tin amd Lead Phthalocyanines", Inorg. Chem., vol. 3, No. 5, pp. 696–698 (May 1964).

Lowery, M.H. et al., "Dichloro)phthalocyanino)silicon", Inorg. Chem., vol. 4, p. 128 (1965).

Moyer, T. J., et al., "Iodine Doped $(SiNcO)_n$—A new Conducting Polymer", Polymer Preps, vol. 25, p. 234–235 (1986).

Rafaeloff, R., et al., "New Group IV Phthalocyanines", J. Inorg. Nucl. Chem., vol. 28, pp. 899–902 (1996).

Wen, T–C., et al., "Synthesis and Photoproperties of Silicon Phthalocyanines and Silicon Naphthalocyanines", J. Clin. Chem. Soc., vol. 40, pp. 141–147 (1993).

Wheeler, B.L. et al., "A Silicon Phthalocyanine and a Silicon Naphthalocyanine; Synthesis, Electrochemistry, and Electrogenerated Chemiluminescence" J. Am. Chem. Soc., vol. 106, p. 7404–7410 (1984).

Witkiewic, Z. et al., "Properties of Octamethoxyphthalocyanines I. On their syntheses, electrical conductivity, and catalytic activity", Material Science, vol. 11, No. 1–2, pp. 39–45 (1976).

* cited by examiner

*Primary Examiner*—John Hardee
(74) *Attorney, Agent, or Firm*—Fay, Sharpe, Fagan, Minnich & McKee, LLP

(57) ABSTRACT

The present invention relates to hybrid metallocyanine ring photosensitizers and mixtures thereof useful in laundry detergent compositions as low hue photobleaches. The hybrid rings are formed from suitable aromatic rings, *nter alia*, 1,2-naphthalene, and 2,3-naphthalene. The present invention also relates to compositions for cleaning and disinfecting hard surfaces. The present invention further relates to methods for photobleaching fabrics and to methods for disinfecting hard surfaces.

18 Claims, No Drawings

PHOTOBLEACHING COMPOSITIONS COMPRISING MIXED METALLOCYANINES

This Applications Claims priority from U.S. Provisional Application No. 60/033,549, filed Jan. 24, 1997.

FIELD OF THE INVENTION

The present invention relates to hybrid metallocyanine photosensitizers and mixtures thereof useful in laundry detergent compositions as low hue photobleaches. The present invention also relates to compositions for cleaning and disinfecting hard surfaces. The present invention further relates to methods for photobleaching fabrics and to methods for disinfecting hard surfaces.

BACKGROUND OF THE INVENTION

It is known that certain water-soluble phthalocyanine, naphthalocyanine, and metallocyanine compounds can be used as photobleaching and anti-microbial agents. Phthalocyanines and naphthalocyanines or their metal complexes can form "singlet oxygen" an oxidative species capable of reacting with stains to bleach them to a colorless and usually water-soluble state.

There are many examples of phthalocyanines and naphthalocyanines photobleaches, the most common being the zinc and aluminum phthalocyanines. In the literature the term "photosensitizer" is often used instead of "photoactivator" and may therefore be considered as standing equally well for the latter term used throughout this specification The prior art teaches phthalocyanine and naphthalocyanine compounds having the general structure

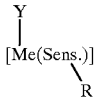

where Me is a transition or non-transition metal, (Sens.) is a phthalocyanine or naphthalocyanine ring which, when combined with a suitable Me unit, is capable of undergoing photosensitization of oxygen molecules, R units are substituent groups which are bonded to the photosensitization ring units (Sens.) to enhance the solubility or photochemical properties of the molecule, and Y units are substituents associated with the metal atom, for example, anions to provide electronic neutrality. The selection of a particular substituent R unit for substitution into the molecule has been the focus of many years of research and these units are typically chosen by the formulator to impart into the target molecule the desired level of water solubility.

A major limitation to the use of phthalocyanine and naphthalocyanine compounds for fabric photobleaching is the fact that these molecules are highly colored materials. Phthalocyanines have Q-band absorption in the range of 600–700 nanometers, while naphthalocyanines have Q-band absorption in the 700–800 nanometer range.

Typically, cyanine rings are formed from four "monomer units" which are reacted together to form a macro cyclic cyanine ring. For example, four equivalents of orthodicyanobenzene react together to form the unsubstituted cyanine ring known as phthalocyanine. Cyanine rings comprised of four identical "monomer units" are, for the purposes of the present invention, defined as "homogeneous" cyanine rings. The properties of many substituted and homogeneous non-hybrid cyanines are well known in the art.

It has now surprisingly been found that "hybrid cyanines and hybrid metallocyanines" and mixtures of hybrid cyanines and metallocyanines produce singlet oxygen thereby having the capacity to act as photobleaches or photodisinfectants. These "hybrid cyanines and metallocyanines" have cyanine rings that are not entirely formed from the same four monomers. For example, the monomer units may comprise any combination of substituted or unsubstituted benzene, naphthalene, anthracene, or phenanthrene rings for A, B C, or D in the general formula below.

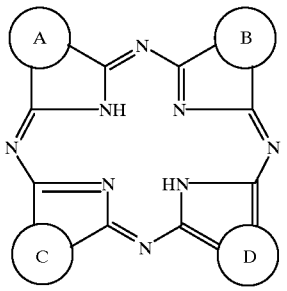

Conventional photobleach materials have a narrow, intense Q-band absorption. By contrast, the mixed cyanines and metallocyanines of the present invention have a broader, less intense Q-band absorption and this reduces the color of the photobleach.

The present invention also provides axially substituted hybrid metallocyanine and mixtures thereof having a high efficiency for singlet oxygen formation and desirable solubility and substantivity properties. The properties of these axially substituted metallocyanine rings can be varied independently of the axial groups. This ability to delineate and selectively modify the key structural elements contributing to the target properties of the molecule allows the formulator to proceed without having to rely upon a "hit and miss" stratagem.

It is an object of the present invention to provide "substantive" and "non-substantive" hybrid metallocyanine photosensitizer mixtures. A "substantive" metallocyanine photosensitizer will be attracted to a surface and a "non-substantive" metallocyanine photosensitizer will repel a surface.

It is a further object of the present invention to provide substantive and non-substantive photobleaching laundry compositions for natural, synthetic or blended fabrics.

It is a further object of the present invention to provide photobleaching compositions that comprise non-aqueous and low aqueous carriers, that is, photobleaching compositions having carriers wherein water constitutes less than half of the carrier liquid.

It is a further object of the present invention to provide substantive and non-substantive photobleaching hard surface cleaning compositions for non-porous hard surfaces, inter alia, Formica®, ceramic tile, glass, or for porous hard surfaces such as concrete or wood.

An object of the present invention is to provide a method for bleaching fabric with laundry compositions comprising hybrid metallocyanine photobleaches of the present invention.

An object of the present invention is to provide a method for cleaning hard surfaces with compositions comprising hybrid metallocyanine photobleaches of the present invention.

BACKGROUND ART

Various patent documents relate to photochemical bleaching or to the use of phthalocyanine and naphthalocyanine compounds as well as their formulation and synthesis. See for example U.S. Pat. No. 3,094,536 issued Jun. 18, 1963; U.S. Pat. No. 3,927,967 issued Dec. 23, 1975; U.S. Pat. No. 4,033,718 issued Jul. 5, 1977; U.S. Pat. No. 4,166,718 issued Sep. 4, 1979. U.S. Pat. No. 4,240,920 issued Dec. 23, 1980; U.S. Pat. No. 4,255,273 issued Mar. 10, 1981; U.S. Pat. No. 4,256,597 issued Mar. 17, 1981; U.S. Pat. No. 4,318,883 issued Mar. 9, 1982; U.S. Pat. No. 4,368,053 issued Jan. 11, 1983; U.S. Pat. No. 4,497,741 issued Feb. 5, 1985; U.S. Pat. No. 4,648,992 issued Mar. 10, 1987; and U.K. Pat. App. 1,372,035 published Oct. 30, 1974; U.K Pat. App. 1,408,144 published Oct. 1, 1975; U.K. Pat App. 2,159,516 published Dec. 4, 1985; E.P. 381,211 A2 published Aug. 8, 1990; E.P. 484,027 A1 published May 6, 1992; WO 91/18006 published Nov. 28, 1991 and Japanese Kokai 06-73397 Derwent Abst. No. (94-128933) published Mar. 15, 1994.

In addition to the above cited patent publications, other references describing the synthesis, preparation and properties of phthalocyanines and naphthalocyanines, incorporated herein also by reference; *Phthalocyanines: Properties and Applications*, Leznoff, C. C. and Lever A. B. P. (Eds), VCH, 1989; *Infrared Absorbing Dyes,* Matsuoka, M. (Ed), Plenum, 1990; *Inorg. Chem.,* Lowery, M. J. et al., 4, pg. 128, (1965); *Inorg. Chem.* Joyner R. D. et al., 1, pg. 236, (1962); *Inorg. Chem.,* Kroenke, W. E. et al., 3, 696, 1964; *Inorg. Chem.* Esposito, J. N. et al., 5, pg. 1979, (1966); *J. Am. Chem. Soc.* Wheeler, B. L. et al., 106, pg. 7404, (1984); *Inorg. Chem.* Ford, W. E, et al., 31, pg. 3371, (1992); *Material Science,* Witkiewicz, Z. et al., 11, pg. 39, (1978); *J. Chem. Soc.* Perkin Trans. I, Cook, M. J., et al., pg. 2453, (1988).

SUMMARY OF THE INVENTION

The present invention relates to hybrid metallocyanine photosensitizing mixtures, the mixtures comprise one or more hybrid photosensitizing compounds each of the compounds represented by the formula:

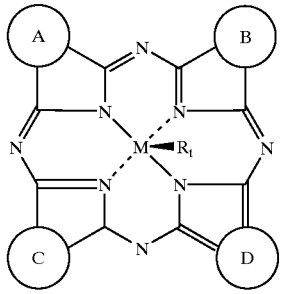

wherein each metallocyanine of the mixture comprises:

a) a photoactive metal or non-metal M wherein said photoactive metal or non-metal M is selected from the group consisting of silicon, germanium, tin, lead, aluminum, platinum, palladium, phosphorous, and mixtures thereof, provided said metal or non-metal has a valence of three or four;

b) aromatic rings A, B, C, and D wherein each ring is independently selected from the group consisting of substituted or unsubstituted benzene, 1,2-naphthalene, 2,3-naphthalene, anthracene, phenathrene, and mixtures thereof; and c) solubility and substantivity mediating axial R units; t has the value of 1 or 2;

provided each photosensitizer of said mixture has a Q-band maximum absorption wavelength of 600 nm or greater.

The photosensitizing compounds described herein are suitable for use in laundry detergent compositions and photodisinfecting compositions.

It is a further object of the present invention to provide photobleaching compositions useful as laundry detergent adjuncts.

It is also and object of the present invention to provide a method for cleaning fabric by contacting the fabric in need of cleaning with the photobleaching compounds of the present invention.

All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

Cleaning compositions according to the present invention effective for disinfecting hard surfaces or fabric comprise:

a) at least about 0.001 ppm, preferably from 0.005 to 2000 ppm, more preferably from 0.1 to 1000 ppm, of a hybrid metallocyanine photosensitizing mixture, the mixture comprising one or more, preferably from about 3 to about 100, more preferably from about 10 to about 100 hybrid compounds according to the present invention; and b) the balance carriers and adjunct materials.

Laundry detergent compositions according to the present invention effective for cleaning fabric comprise:

a) at least about 0.1%, preferably from about 0.1% to about 95%, more preferably from about 0.1% to about 30% by weight, of a detersive surfactant, said surfactant is selected from the group consisting of anionic, cationic, nonionic, zwitterionic, ampholytic surfactants, and mixtures thereof;

b) at least about 0.001 ppm, preferably from 0.005 to 2000 ppm, more preferably from 0.1 to 1000 ppm, of a hybrid cyanine photobleach according to the present invention; and c) the balance carriers and adjunct materials.

Preferred laundry detergent compositions according to the present invention comprise:

a) at least about 0.1%, preferably from about 0.1% to about 30%, more preferably from about 1% to about 30%, most preferably from about 5% to about 20% by weight, of a detersive surfactant, said detersive surfactant is selected from the group consisting of anionic, cationic, nonionic, zwitterionic, ampholytic surfactants, and mixtures thereof;

b) at least about 0.001 ppm, preferably from about 0.01 to about 10000 ppm, more preferably from about 0.1 to about 5000 ppm, most preferably form about 10 to about 1000 ppm, of a hybrid cyanine photobleach according to the present invention;

c) at least about 0.01% by weight, of a soil release agent; and d) carriers and adjunct ingredients.

Further preferred laundry detergent compositions according to the present invention comprise:

a) at least about 0.1%, preferably from about 0.1% to about 30%, more preferably from about 1% to about 30%, most preferably from about 5% to about 20% by weight, of a detersive surfactant, said detersive surfactant is selected from the group consisting of anionic, cationic, nonionic, zwitterionic, ampholytic surfactants, and mixtures thereof;

b) at least about 0.001 ppm, preferably from about 0.01 to about 10000 ppm, more preferably from about 0.1 to about 5000 ppm, most preferably form about 10 to about 1000 ppm, of a hybrid cyanine photobleach according to the present invention;

c) at least about 0.01% by weight, of a non-halogen bleach; and d) carriers and adjunct ingredients.

Still further preferred laundry detergent compositions according to the present invention comprise:

a) at least about 0.1%, preferably from about 0.1% to about 30%, more preferably from about 1% to about 30%, most preferably from about 5% to about 20% by weight, of a detersive surfactant, said detersive surfactant is selected from the group consisting of anionic, cationic, nonionic, zwitterionic, ampholytic surfactants, and mixtures thereof;

b) at least about 0.001 ppm, preferably from about 0.01 to about 10000 ppm, more preferably from about 0.1 to about 5000 ppm, most preferably form about 10 to about 1000 ppm, of a hybrid cyanine photobleach according to the present invention;

c) at least about 0.01% by weight, of a modified polyamine dispersent; and d) carriers and adjunct ingredients.

For the purposes of the present invention substituted aryl units are defined as moieties having the formula:

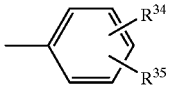

wherein $R^{34}$ and $R^{35}$ are independently selected from the group consisting of hydrogen, $C_1$–$C_6$ alkyl, $C_2$–$C_6$ alkenyl, $C_1$–$C_6$ alkoxy, $C_3$–$C_6$ branched alkoxy, halogen, morpholino, cyano, nitrilo, —$CO_2^-M^+$, —$SO_3^-M^+$, —$OSO_3^-M^+$, —$N(R^{36})_2$, and —$N^+(R^{36})_3X^-$ wherein each $R^{36}$ is independently hydrogen, $C_1$–$C_6$ alkyl, $(CH_2)_nOH$, —$(CH_2CH_2O)_nH$, and mixtures thereof; wherein n is from 1 to 4; M is a water soluble cation and X is chlorine, bromine, iodine, or other water soluble anion. Examples of other water soluble anions include organic species such as fumarate, tartrate, oxalate and the like, inorganic species include sulfate, hydrogen sulfate, phosphate and the like.

For the purposes of the present invention alkylenearyl units are defined as moieties having the formula:

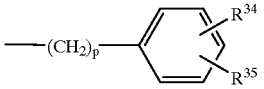

wherein $R^{34}$ and $R^{35}$ are the same as define above, p is from 1 to about 10.

For the purposes of the present invention aryloxy units are defined as moieties having the formula:

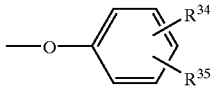

wherein $R^{34}$ and $R^{35}$ are the same as define above.

For the purposes of the present invention alkyleneoxyaryl units are defined as moieties having the formula:

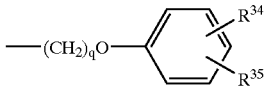

wherein $R^{34}$ and $R^{35}$ are the same as define above, q is from 0 to about 10.

For the purposes of the present invention oxyalkylenearyl units are defined as moieties having the formula:

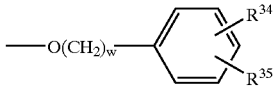

wherein $R^{34}$ and $R^{35}$ are the same as define above, w is from 1 to about 10.

For the purposes of the present invention branched alkoxy units are defined as moieties having the formula

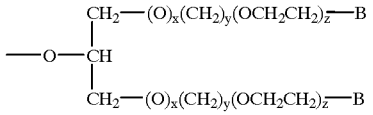

or

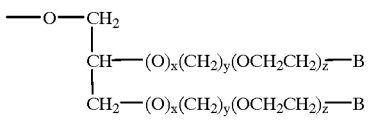

wherein B is hydrogen, hydroxyl, $C_1$–$C_{30}$ alkyl, $C_1$–$C_{30}$ alkoxy, —$CO_2H$, $OCH_2CO_2H$, —$SO_3^-M^+$, —$OSO_3^-M^+$, —$PO_3^{2-}M$, —$OPO_3^{2-}M$, and mixtures thereof; preferably $C_1$–$C_{18}$ alkyl, —$CO_2H$, —$SO_3^-M^+$, —$OSO_3^-M^+$, —$PO_3^{2-}M$, —$OPO_3^{2-}M$ preferably —$SO_3^-M^+$ or —$OSO_3^-M^+$; M is a water soluble cation in sufficient amount to satisfy charge balance; x is 0 or 1, each y independently has the value from 0 to 6, each z independently has the value from 0 to 100.

For the purposes of the present invention both substituted and un-substituted aryl, alkylenearyl, aryloxy, oxyalkylenearyl and alkyleneoxyaryl have the indices p, q, and w as defined herein above, and aryl can be any aromatic moiety substituted or unsubstituted including heterocycles, for example, phenyl. naphthyl, thienyl, pyridinyl, etc.

For the purposes of the present invention alkylethyleneoxy units are defined as moieties having the formula:

$$—(A)_k—(CH_2)_m(OCH_2CH_2)_nZ$$

wherein A is the heteroatom nitrogen or oxygen preferably A is oxygen, the index k is 0 when the heteroatom is absent, k is equal to 1 when the heteroatom is present, Z is hydrogen, $C_1$–$C_6$ alkoxy, aryl, substituted aryl, aryloxy, substituted aryloxy, alkyleneamino, —$SO_3^-M^+$, —$OSO_3^-M^+$, —$CO_2H$, and mixtures thereof; m is from 0 to 12 and n is from 1 to 100.

For the purposes of the present invention alkyleneamino units are defined as moieties having the for mula:

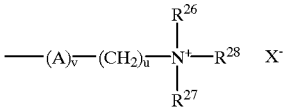

wherein $R^{26}$, and $R^{27}$ are each a $C_1$–$C_{22}$ alkyl, $C_3$–$C_{22}$ branched alkyl, $C_2$–$C_{22}$ alkenyl, $C_3$–$C_{22}$ branched alkenyl, $R^{28}$ is hydrogen, $C_1$–$C_{22}$ alkyl, $C_3$–$C_{22}$ branched alkyl, $C_2$–$C_{22}$ alkenyl, $C_3$–$C_{22}$ branched alkenyl and mixtures thereof, A is the heteroatom nitrogen or oxygen, preferably A is oxygen, the index v is 0 when the heteroatom is absent, v is equal to 1 when the heteroatom is present, X is chloride, bromide, iodide, or other water soluble anion, u is from 0 to 22. Examples of other water soluble anions include organic species such as fumarate, irate, oxalate and the like, inorganic species include sulfate, hydrogen sulfate, phosphate and the like.

Hybrid Cyanine Rings

The photosensitizers of the present invention suitable for use as photobleaches and photodisinfectants comprise hybrid cyanine rings. These hybrid rings are formed by chemically reacting together at least two aromatic monomer units capable of forming a cyanine ring. Typically, cyanine rings are defined by the type of aromatic monomer unit used to synthesize the target macrocyclic ring, for example, phthalocyanines are formed from derivatives of benzene, naphthalocyanines are formed from derivatives of naphthylene, etc.

The hybrid cyanine rings of the present invention have the general formula

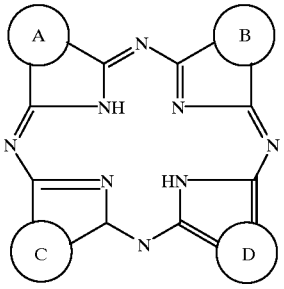

wherein A, B, C, and D represent aromatic rings. For the purposes of the present invention these aromatic rings are preferably substituted or unsubstituted benzene, 1,2-naphthylene, 2,3-naphthalene, anthracene, and phenanthrene. However, this list is not meant to be inclusive or exclusive of any other aromatic ring capable of insertion into the cyanine ring.

The cyanine rings of the present invention are formed from two or more different monomers. The monomers can be different in the type of ring substitution, the geometry of the ring substituents, the type of aromatic ring, or mixtures thereof. Typically, ortho substituted aromatic di-cyano compounds are suitable starting materials for the cyanine rings. However, the present invention includes any suitable method for preparing hybrid cyanine compounds and their mixtures.

For the purpose of further illustrating the present invention, the formulas below depict the expected mixture of cyanine rings obtained when the cyanine ring forming monomers, 1,6-dimethoxy-3,4-dicyanobenzene and 1,6-dibromo-3,4-dicyanobenzene, are reacted together under suitable conditions.

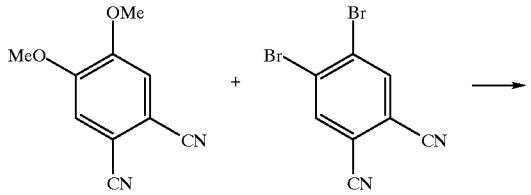

Reacted together under suitable conditions yield:

I

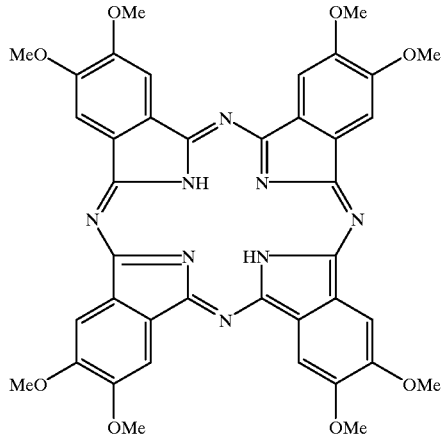

II

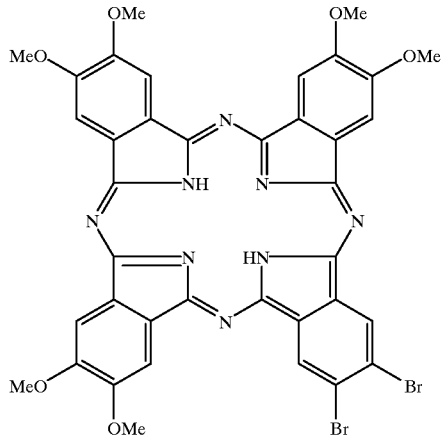

-continued
III
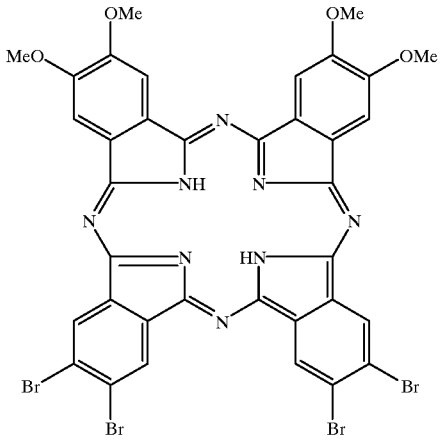
IV
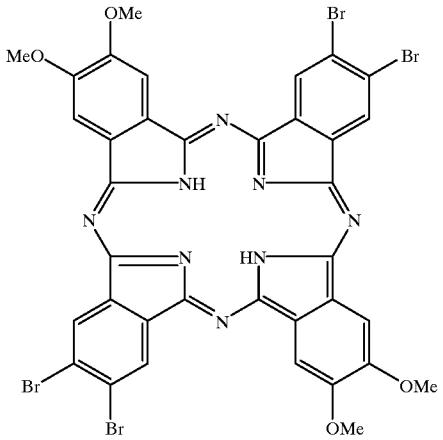
V
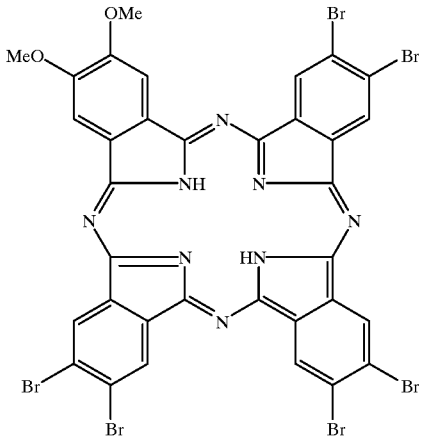
-continued
VI
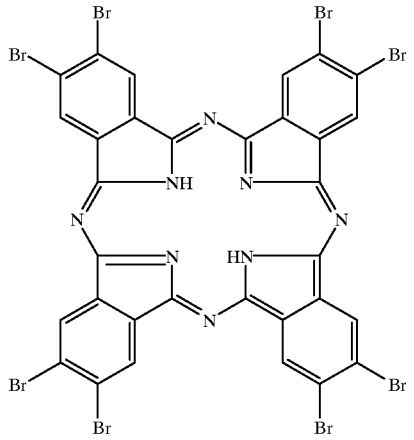
Other examples include but are not limited to the reaction of ortho-dicyanobenzene and 2,3dicyanonaphthalene as shown below
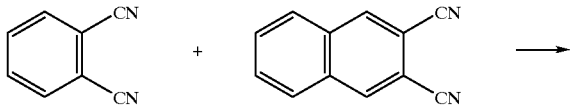
or the reaction of the corresponding phthalimidines as shown below
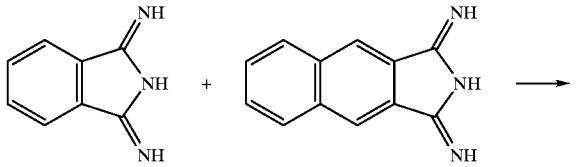
to yield the mixture of hybrid cyanines I–VI shown below.
I
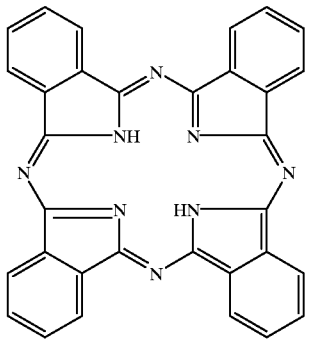

II
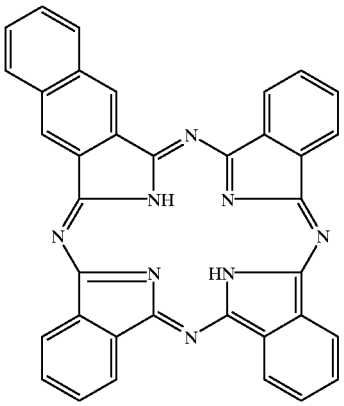
III
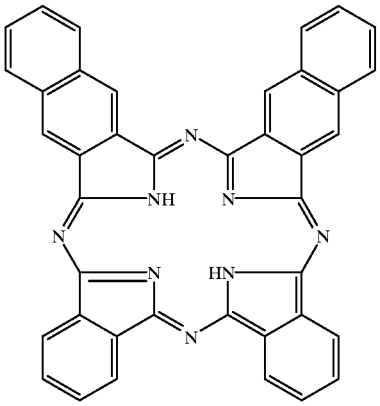
IV
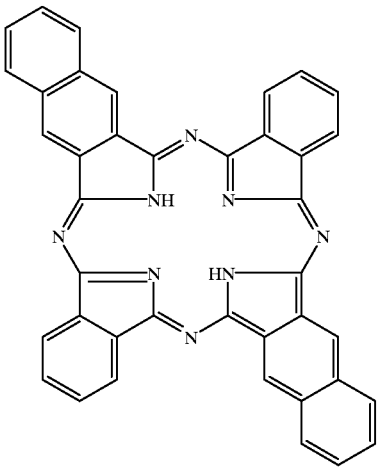
V
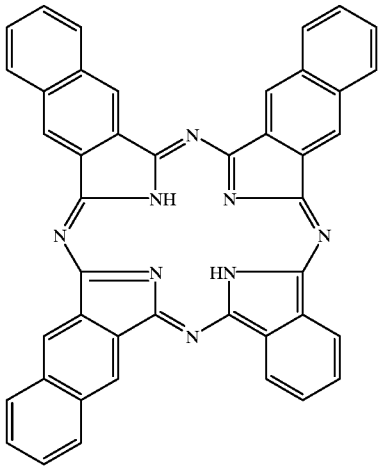
VI
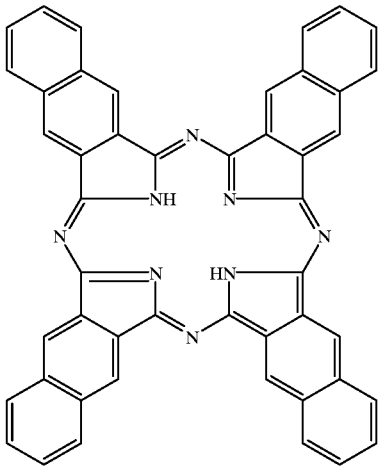
Other examples include but are not limited to the reaction of 1,4dibutoxy-2,3-dicyanobenzene and 2,3-dicyanonaphthalene as shown below
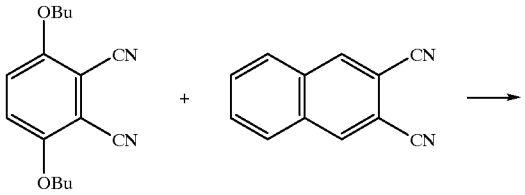

to yield the mixture of hybrid cyanines I–VI shown below.
I
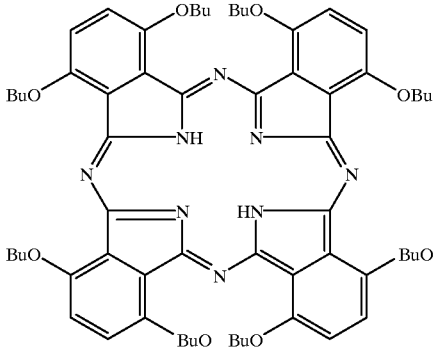
II
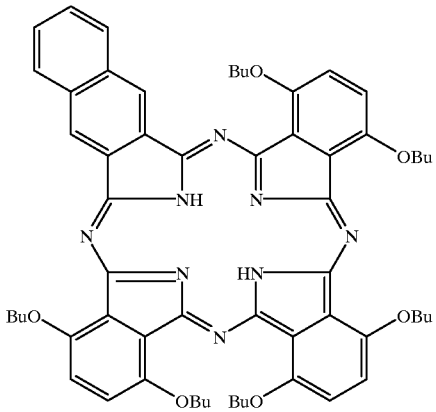
III
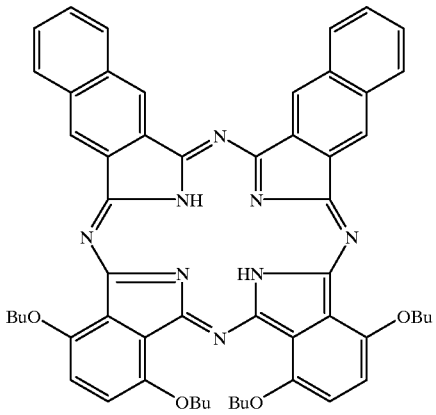
-continued
IV
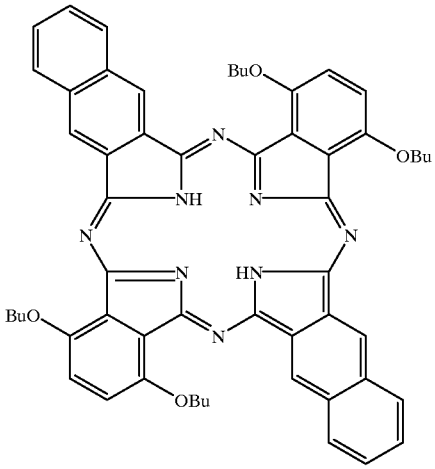
V
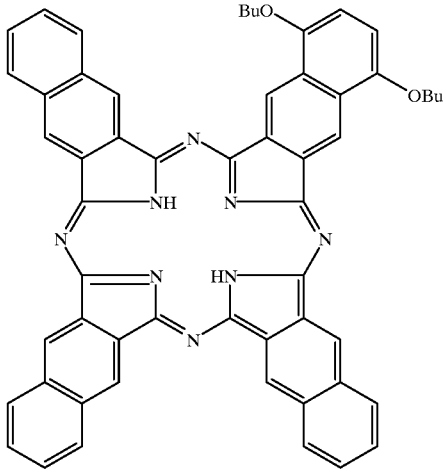
VI
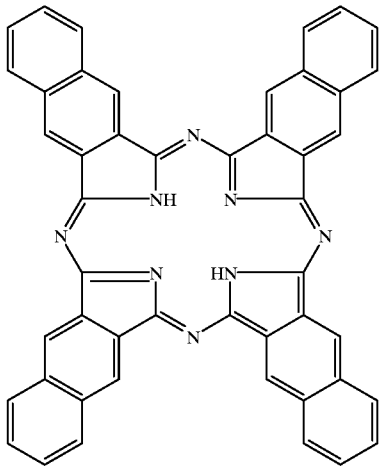

The term "hybrid cyanine" covers the mixture of materials formed when two or more monomers are reacted. Those skilled in the art will recognize that his mixture contains non-hybrid structures, the non-hybrid structures fall within the definition of "hybrid cyanines" for the purposes of the present invention. It will also be recognized that as the number of different monomers increases the number of possible hybrid rings and non-hybrid rings formed also increases.

As indicated above, the "hybrid cyanines" can be formed from several monomers. In addition, the stoichiometric ratio of those monomers can be varied. The following provides non-limiting examples of reactions to form mixed cyanines.

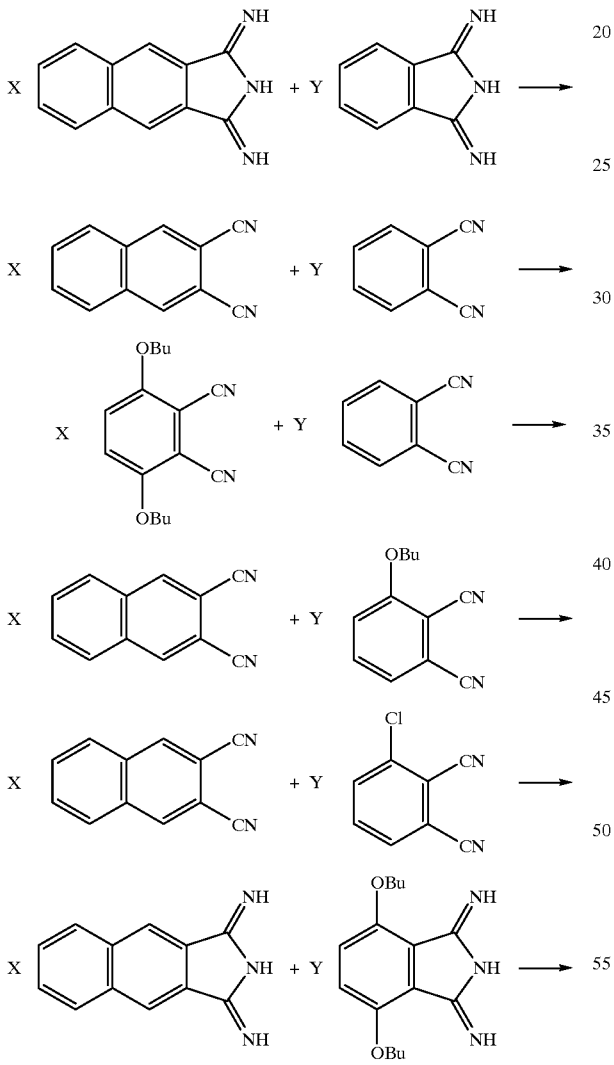

wherein the ratio of the indices x and y indicate the stoichiometric amounts of each reactant said reactant ratios can range from 0.01 to 100, that is the value of x can be 1 when the value of y is 100 and the value of x can be 100 when the value of y is 1. The following formula

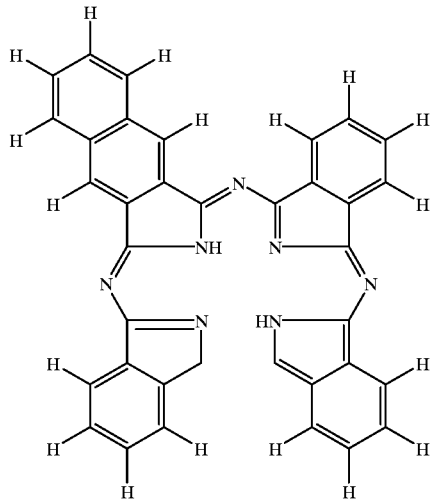

is a major product from the following reaction stoichiometry

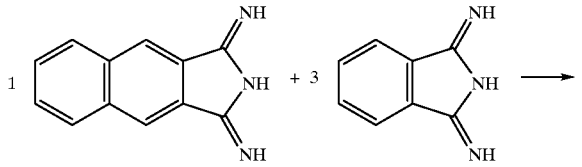

For the purposes of the present invention ring components derived from substituted and unsubstituted benzene can be written in either of two equivalent resonance formulas:

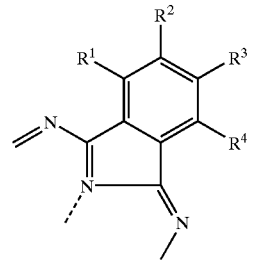

or

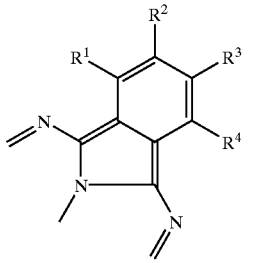

wherein $R^1$, $R^2$, $R^3$ and $R^4$ are each independently selected from the substituents described herein below.

For the purposes of the present invention ring components derived from substituted and unsubstituted 2,3-naphthylene can be written in either of two equivalent resonance formulas:

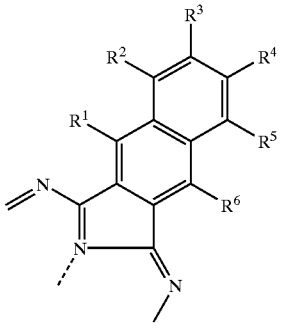

or

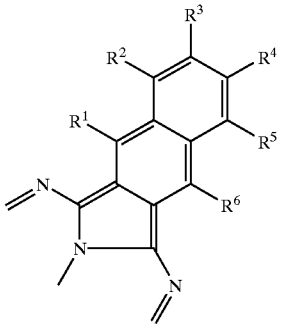

wherein $R^1$, $R^2$, $R^3$, $R^4$, $R^5$, and $R^6$ are independently selected from the substituents described herein below.

For the purposes of the present invention ring components derived from substituted and unsubstituted 1,2-naphthylene can be written in either of two equivalent resonance formulas:

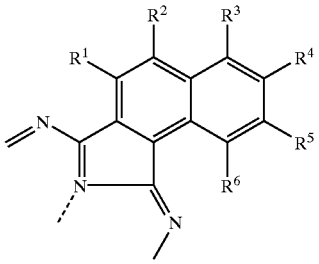

or

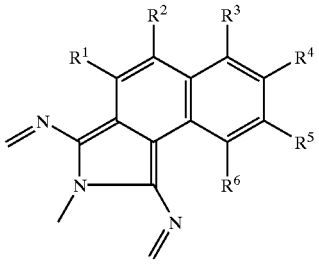

wherein $R^1$, $R^2$, $R^3$, $R^4$, $R^5$, and $R^6$ units are independently selected from the substituents listed herein below.

For the purposes of the present invention ring components derived from substituted and unsubstituted anthracene can be written in either of two equivalent resonance formulas:

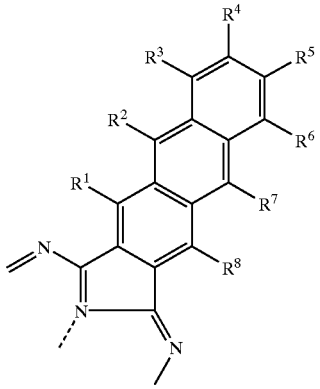

or

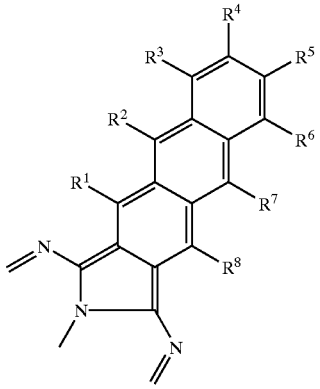

wherein $R^1$, $R^2$, $R^3$, $R^4$, $R^5$, $R^6$, $R^7$, and $R^8$ units are independently selected from the substituents described herein below.

For the purposes of the present invention ring components derived from substituted and unsubstituted phenanthrene can be written in either of two equivalent resonance formulas:

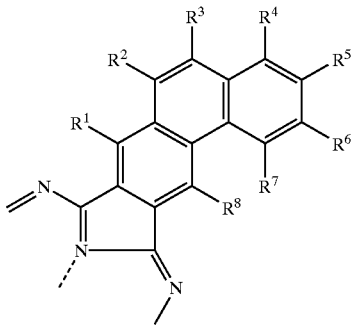

or

-continued

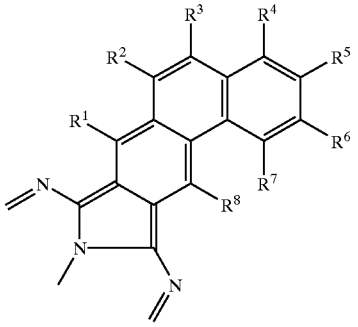

wherein $R^1$, $R^2$, $R^3$, $R^4$, $R^5$, $R^6$, $R^7$, and $R^8$ units are independently selected from the substituents described herein below.

Aromatic Ring Substituents

The hybrid cyanines of the present invention may be substituted or unsubstituted that is the $R^1$, $R^2$, $R^3$, $R^4$, $R^5$, $R^6$, $R^7$, and $R^8$ units comprise:

a) hydrogen;

b) halogen;

c) hydroxyl;

d) cyano;

e) nitrilo;

f) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

g) halogen substituted $C_1$–$C_{22}$ alkyl, $C_3$–$C_{22}$ branched alkyl, $C_2$–$C_{22}$ alkenyl, $C_3$–$C_{22}$ branched alkenyl or mixtures thereof;

h) polyhydroxyl substituted $C_3$–$C_{22}$ alkyl;

i) $C_1$–$C_{22}$ alkoxy, preferably $C_1$–$C_4$ alkoxy, more preferred methoxy;

j) branched alkoxy having the formula

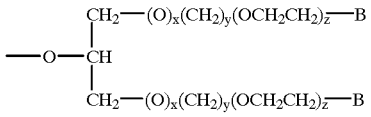

or

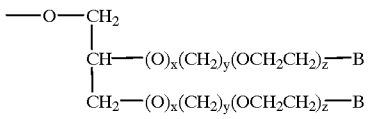

wherein B is hydrogen, hydroxyl, $C_1$–$C_{30}$ alkyl, $C_1$–$C_{30}$ alkoxy, —$CO_2H$, —$OCH_2CO_2H$, —$SO_3^-M^+$, —$OSO_3^-M^+$, —$PO_3^{2-}M$, —$OPO_3^{2-}M$, and mixtures thereof; M is a water soluble cation in sufficient amount to satisfy charge balance; x is 0 or 1, each y independently has the value from 0 to 6, preferably from 0 to 6; each z independently has the value from 0 to 100, preferably from 0 to about 10, more preferably from 0 to about 3;

k) aryl, and substituted aryl having the formula:

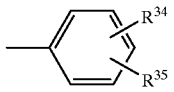

wherein $R^{34}$ and $R^{35}$ are independently selected from the group consisting of hydrogen, $C_1$–$C_6$ alkyl, $C_2$–$C_6$ alkenyl, $C_1$–$C_6$ alkoxy, $C_3$–$C_6$ branched alkoxy, halogen, morpholino, cyano, nitrilo, —$CO_2^-M^+$, —$SO_3^-M^+$, —$OSO_3^-M^+$, —$N(R^{36})_2$, and —$N^+(R^{36})_3X^-$ wherein each $R^{36}$ is independently hydrogen, $C_1$–$C_6$ alkyl, —$(CH_2)_nOH$, —$(CH_2CH_2O)_nH$, and mixtures thereof; wherein n is from 1 to 4; preferably hydrogen $C_1$–$C_6$ alkyl, —$CO_2^-M^+$, —$SO_3^-M^+$, —$OSO_3^-M^+$, and mixtures thereof, more preferably $R^{34}$ or $R^{35}$ is hydrogen and the other moiety is $C_1$–$C_6$; wherein M is a water soluble cation and X is chlorine, bromine, iodine, or other water soluble anion. Examples of other water soluble anions include organic species such as fumarate, tartrate, oxalate and the like, inorganic species include sulfate, hydrogen sulfate, phosphate and the like;

l) alkylenearyl and substituted alkylenearyl having the formula:

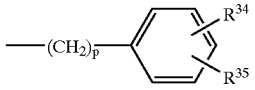

wherein $R^{34}$ and $R^{35}$ are independently selected from the group consisting of hydrogen, $C_1$–$C_6$ alkyl, $C_2$–$C_6$ alkenyl, $C_1$–$C_6$ alkoxy, $C_3$–$C_6$ branched alkoxy, halogen, morpholino, cyano, nitrilo, —$CO_2^-M^+$, —$SO_3^-M^+$, —$OSO_3^-M^+$, —$N(R^{36})_2$, and —$N^+(R^{36})_3X^-$ wherein each $R^{36}$ is independently hydrogen, $C_1$–$C_6$ alkyl, —$(CH_2)_nOH$, —$(CH_2CH_2O)_nH$, and mixtures thereof; wherein n is from 1 to 4; preferably hydrogen $C_1$–$C_6$ alkyl, —$CO_2^-M^+$, —$SO_3^-M^+$, —$OSO^{3-}M^+$, and mixtures thereof, more preferably $R^{34}$ or $R^{35}$ is hydrogen and the other moiety is $C_1$–$C_6$; wherein M is a water soluble cation and X is chlorine, bromine, iodine, or other water soluble anion. Examples of other water soluble anions include organic species such as fumarate, tartrate, oxalate and the like, inorganic species include sulfate, hydrogen sulfate, phosphate and the like; p is from 1 to about 10, preferably from 1 to about 3;

m) aryloxy and substituted aryloxy having the formula:

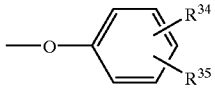

wherein $R^{34}$ and $R^{35}$ are independently selected from the group consisting of hydrogen, $C_1$–$C_6$ alkyl, $C_2$–$C_6$ alkenyl, $C_1$–$C_6$ alkoxy, $C_3$–$C_6$ branched alkoxy, halogen, morpholino, cyano, nitrilo, —$CO_2^-M^+$, —$SO_3^-M^+$, —$OSO_3^-M^+$, —$N(R^{36})_2$, and —N+$(R^{36})_3X^-$ wherein each $R^{36}$ is independently hydrogen, $C_1$–$C_6$ alkyl, —$(CH_2)_nOH$, —$(CH_2CH_2O)_nH$, and mixtures thereof; wherein n is from 1 to 4; preferably hydrogen $C_1$–$C_6$ alkyl, —$CO_2^-M^+$, —$SO_3^-M^+$, —$OSO_3^-M^+$, and mixtures thereof, more preferably $R^{34}$ or $R^{35}$ is hydrogen and the other moiety is $C_1$–$C_6$; wherein M is a water soluble cation and X is chlorine, bromine, iodine, or other water soluble anion. Examples of other water soluble anions include organic species such as fumarate, tartrate, oxalate and the like, inorganic species include sulfate, hydrogen sulfate, phosphate and the like;

n) alkyleneoxyaryl and substituted alkyleneoxyarylalkyleneoxyaryl units are defined as moieties having the formula:

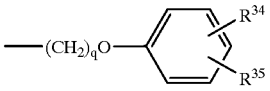

wherein $R^{34}$ and $R^{35}$ are independently selected from the group consisting of hydrogen, $C_1$–$C_6$ alkyl, $C_2$–$C_6$ alkenyl, $C_1$–$C_6$ alkoxy, $C_3$–$C_6$ branched alkoxy, halogen, morpholino, cyano, nitrilo, —$CO_2^-M^+$, —$SO_3^-M^+$, —$OSO_3^-M^+$, —$N(R^{36})_2$, and —$N^+(R^{36})_3X^-$ wherein each $R^{36}$ is independently hydrogen, $C_1$–$C_6$ alkyl, —$(CH_2)_nOH$, —$(CH_2CH_2O)_nH$, and mixtures thereof; wherein n is from 1 to 4; preferably hydrogen $C_1$–$C_6$ alkyl, —$CO_2^-M^+$, —$SO_3^-M^+$, —$OSO_3^-M^+$, and mixtures thereof, more preferably $R^{34}$ or $R^{35}$ is hydrogen and the other moiety is $C_1$–$C_6$; wherein M is a water soluble cation and X is chlorine, bromine, iodine, or other water soluble anion. Examples of other water soluble anions include organic species such as fumarate, tartrate, oxalate and the like, inorganic species include sulfate, hydrogen sulfate, phosphate and the like; q is from 0 to about 10 preferably from about 1 to about 3;

o) oxyalkylenearyl and substituted oxyalkylenearyl having the formula:

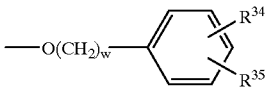

wherein $R^{34}$ and $R^{35}$ are independently selected from the group consisting of hydrogen, $C_1$–$C_6$ alkyl, $C_2$–$C_6$ alkenyl, $C_1$–$C_6$ alkoxy, $C_3$–$C_6$ branched alkoxy, halogen, morpholino, cyano, nitrilo, —$CO_2^-M^+$, —$SO_3^-M^+$, —$OSO_3^-M^+$, —$N(R^{36})_2$, and —$N^+(R^{36})_3X^-$ wherein each $R^{36}$ is independently hydrogen, $C_1$–$C_6$ alkyl, —$(CH_2)_nOH$, $(CH_2CH_2O)_nH$, and mixtures thereof; wherein n is from 1 to 4; preferably hydrogen $C_1$–$C_6$ alkyl, —$CO_2^-M^+$, —$SO_3^-M^+$, —$OSO_3^-M^+$, and mixtures thereof, more preferably $R^{34}$ or $R^{35}$ is hydrogen and the other moiety is $C_1$–$C_6$; wherein M is a water soluble cation and X is chlorine, bromine, iodine, or other water soluble anion. Examples of other water soluble anions include organic species such as fumarate, tartrate, oxalate and the like, inorganic species include sulfate, hydrogen sulfate, phosphate and the like; w is from 1 to about 10, preferably from about 1 to about 3;

p) $C_1$–$C_{22}$ thioalkyl, $C_3$–$C_{22}$ substituted thioalkyl, and mixtures thereof;

q) ester units of the formula —$CO_2R^{25}$ wherein $R^{25}$ is $C_1$–$C_{22}$ alkyl, $C_3$–$C_{22}$ branched alkyl, $C_2$–$C_{22}$ alkenyl, $C_3$–$C_{22}$ branched alkenyl, all of which can be substituted with halogen; polyhydroxyl substituted $C_3$–$C_{22}$ alkyl, $C_3$–$C_{22}$ glycol; $C_1$–$C_{22}$ alkoxy, $C_3$–$C_{22}$ branched alkoxy; aryl, substituted aryl, alkylenearyl, aryloxy, alkyleneoxyaryl, alkyleneoxyaryl; preferably $C_1$–$C_{22}$ alkyl, $C_3$–$C_{22}$ branched alkyl, and mixtures thereof;

r) alkyleneamino units having the formula:

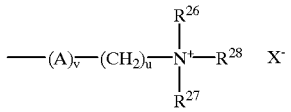

wherein $R^{26}$, and $R^{27}$ are each a $C_1$–$C_{22}$ alkyl, $C_3$–$C_{22}$ branched alkyl, $C_2$–$C_{22}$ alkenyl, $C_3$–$C_{22}$ branched alkenyl, $R^{28}$ is hydrogen, $C_1$–$C_{22}$ alkyl, $C_3$–$C_{22}$ branched alkyl, $C_2$–$C_{22}$ alkenyl, $C_3$–$C_{22}$ branched alkenyl and mixtures thereof, A is the heteroatom nitrogen or oxygen, preferably A is oxygen, the index v is 0 when the heteroatom is absent, v is equal to 1 when the heteroatom is present, preferably v is equal to 0; X is chloride, bromide, iodide, or other water soluble anion, u is from 0 to 22, preferably u is from 3 to about 10. Examples of other water soluble anions include organic species such as fumarate, tartrate, oxalate and the like, inorganic species include sulfate, hydrogen sulfate, phosphate and the like;

s) an amino unit of the formula

—$NR^{29}R^{30}$ wherein $R^{29}$ and $R^{30}$ comprises $C_1$–$C_{22}$ alkyl, $C_3$–$C_{22}$ branched alkyl, $C_2$–$C_{22}$ alkenyl, $C_3$–$C_{22}$ branched alkenyl, and mixtures thereof;

t) alkylethyleneoxy units having the formula:

—$(A)_k$—$(CH_2)_m(OCH_2CH_2)_nZ$ wherein A is nitrogen or oxygen, preferably A is oxygen, the index k is 0 when the heteroatom is absent, k is equal to 1 when the heteroatom is present, Z is hydrogen, $C_1$–$C_6$ alkoxy, aryl, substituted aryl, aryloxy, substituted aryloxy, alkyleneamino, —$SO_3^-M^+$, —$OSO_3^-M^+$, —$CO_2H$, and mixtures thereof, preferably hydrogen or $C_1$–$C_6$ alkoxy, more preferably methoxy; n is from 1 to 100, preferably from 0 to about 20, more preferably from 3 to about 10; and m is from 1 to 12, preferably from about 1 to about 5;

u) siloxy and substituted siloxy of the formula —$OSiR^{31}R^{32}R^{33}$ wherein each $R^{31}$, $R^{32}$, and $R^{33}$ is independently selected from the group consisting of $C_1$–$C_8$ alkyl, $C_3$–$C_8$ branched alkyl, $C_2$–$C_8$ alkenyl, $C_3$–$C_8$ branched alkenyl, substituted alkyl, aryl, alkylethyleneoxy units of the formula —$(A)_k$—$(CH_2)_m(OCH_2CH_2)_nZ$ wherein Z is hydrogen, $C_1$–$C_{30}$ alkyl, hydroxyl, —$CO_2H$, —$SO_3^-M^+$, —$OSO_3^-M^+$, $C_1$–$C_6$ alkoxy, aryl, substituted aryl, aryloxy, substituted aryloxy alkyleneamino; and mixtures thereof; A units comprise nitrogen or oxygen, M is a water soluble cation, k is 0 or 1, n is from 0 to 100, m is from 0 to 12; and mixtures thereof; and, alkyleneamino units and mixtures thereof.

Preferred aromatic ring substituents are hydrogen, halogen, and mixtures thereof, preferably chlorine, bromine, iodine, and mixtures thereof, more preferably bromine;

$C_1$–$C_{22}$ alkoxy, preferably $C_1$–$C_4$ alkoxy, more preferably methoxy; substituted or unsubstituted aryloxy, preferably unsubstituted, sulphonate or carboxylate substituted; $C_1$–$C_6$ linear or branched alkyl; and $C_2$–$C_6$ linear or branched alkenyl.

Metal and Non-metal Atoms

The cyanine rings of the present invention may optionally be chelated to a suitable metal. Any photoactive metal or non-metal is suitable for use as the central atom chelated by the cyanine ring. Preferred metals and non-metals are zinc, silicon, germanium, tin, lead, aluminum, platinum, palladium, and phosphorous, more preferred are silicon, tin and germanium..

The following is an example of a metal or non-metal atom combined with a cyanine ring:

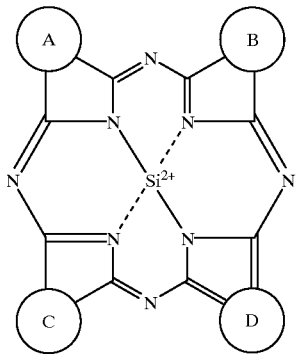

wherein the central atom comprises a $Si^{4+}$ atom chelated to a hybrid cyanine. The hybrid rings of the present invention occupy two chemical valences of each metal or non-metal that is chelated. In the example above, a silicon atom with a valence of four (4+) is chelated by a phthalocyanine ring. Two of the silicon valences are occupied with chelation while the remaining valences are used for bonding to an "axial R units". Not all central atoms suitable for use as photoactive metals or non-metals have a valence of four. For example, aluminum atoms have a valence of three (3+). Therefore, as in the case of aluminum, two valences are occupied with chelation to the hybrid ring while the remaining valence is directed to bonding with an axial R unit.

Axial R Units

The photosensitizing compounds of the present invention may optionally comprise R units that are axially bonded to the central metal or non-metal atom of the photoactive cyanine ring system. These R units are covalently bonded to the central atom.

Axial R groups are present in preferred examples of the present invention as they mediate non-photochemical properties of the photosensitizing compounds. For example, and not by way of limitation, axial R units may provide the photosensitizers with fabric substantive properties as well as increased or decreased solubility. Formulators may desire slow dissolving photobleaches that are released into the laundry liquor at the end of the wash cycle. By manipulation of the axial R units, photobleach properties can be fine tuned to meet the needs of a particular product formulation and application.

In addition to the solubility properties, axial R units may be selected to prevent molecular stacking of metallocyanine rings. By limiting the ability of the photosensitizing compounds to "stack", singlet oxygen is more efficiently produced and delivered to the target site. Fabric substantivity is also effected by the selection of the axial R unit. For molecules comprising more than one axial R unit the formulator may select each independently for different properties, e.g., solubility for one and substantivity for the other.

The compounds useful for the present invention comprise axial R units covalently bonded to the central metal atom, wherein each R is independently selected from the group consisting of:

a) hydrogen;

b) halogen;

c) hydroxyl;

d) cyano;

e) nitrilo;

f) oximino;

g) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

h) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

i) polyhydroxyl substituted $C_3$–$C_{22}$ alkyl;

j) $C_1$–$C_{22}$ alkoxy, preferably $C_1$–$C_4$ alkoxy, more preferred methoxy;

k) branched alkoxy having the formula

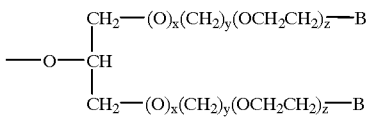

or

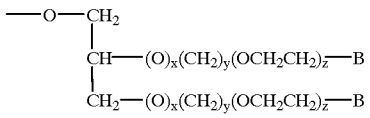

wherein B is hydrogen, hydroxyl, $C_1$–$C_{30}$ alkyl, $C_1$–$C_{30}$ alkoxy, —$CO_2H$, —$OCH_2CO_2H$, —$SO_3^-M^+$, —$OSO_3^-M^+$, —$PO_3^{2-}M$, —$OPO_3^{2-}M$, and mixtures thereof; M is a water soluble cation in sufficient amount to satisfy charge balance; x is 0 or 1, each y independently has the value from 0 to 6, preferably from 0 to 6; each z independently has the value from 0 to 100, preferably from 0 to about 10, more preferably from 0 to about 3;

l) aryl, and substituted aryl having the formula:

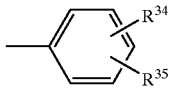

wherein $R^{34}$ and $R^{35}$ are independently selected from the group consisting of hydrogen, $C_1$–$C_6$ alkyl, $C_2$–$C_6$ alkenyl, $C_1$–$C_6$ alkoxy, $C_3$–$C_6$ branched alkoxy, halogen, morpholino, cyano, nitrilo, —$CO_2^-M^+$, —$SO_3^-M^+$, —$OSO_3^-M^+$, —$N(R^{36})_2$, and —$N^+(R^{36})_3X^-$ wherein each $R^{36}$ is independently hydrogen, $C_1$–$C_6$ alkyl, —$(CH_2)_nOH$, —$(CH_2CH_2O)_nH$, and mixtures thereof; wherein n is from 1 to 4; preferably hydrogen $C_1$–$C_6$ alkyl, —$CO_2^-M^+$, —$SO_3^-M^+$, —$OSO_3^-M^+$, and mixtures thereof, more preferably $R^{34}$ or $R^{35}$ is hydrogen and the other moiety is $C_1$–$C_6$; wherein M is a water soluble cation and X is chlorine, bromine, iodine, or other water soluble anion. Examples of other water soluble anions include organic species such as fumarate, tartrate, oxalate and the like, inorganic species include sulfate, hydrogen sulfate, phosphate and the like;

m) alkylenearyl and substituted alkylenearyl having the formula:

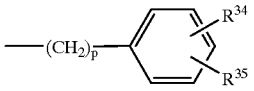

wherein $R^{34}$ and $R^{35}$ are independently selected from the group consisting of hydrogen, $C_1$–$C_6$ alkyl, $C_2$–$C_6$ alkenyl, $C_1$–$C_6$ alkoxy, $C_3$–$C_6$ branched alkoxy, halogen, morpholino, cyano, nitrilo, —$CO_2^-M^+$, —$SO_3^-M^+$, —$OSO_3^-M^+$, —$N(R^{36})_2$, and —$N^+(R^{36})_3X^-$ wherein each $R^{36}$ is independently hydrogen, $C_1$–$C_6$ alkyl, —$(CH_2)_nOH$, —$(CH_2CH_2O)_nH$, and mixtures thereof; wherein n is from 1 to 4; preferably hydrogen $C_1$–$C_6$ alkyl, —$CO_2^-M^+$, —$SO_3^-M^+$, —$OSO_3^-M^+$, and mixtures thereof, more preferably $R^{34}$ or $R^{35}$ is hydrogen and the other moiety is $C_1$–$C_6$; wherein M is a water soluble cation and X is chlorine, bromine, iodine, or other water soluble anion. Examples of other water soluble anions include organic species such as fumarate, tartrate, oxalate and the like, inorganic species include sulfate, hydrogen sulfate, phosphate and the like; p is from 1 to about 10, preferably from 1 to about 3;

n) aryloxy and substituted aryloxy having the formula:

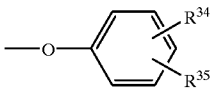

wherein $R^{34}$ and $R^{35}$ are independently selected from the group consisting of hydrogen, $C_1$–$C_6$ alkyl, $C_2$–$C_6$ alkenyl, $C_1$–$C_6$ alkoxy, $C_3$–$C_6$ branched alkoxy, halogen, morpholino, cyano, nitrilo, —$CO_2^-M^+$, —$SO_3^-M^+$, —$OSO_3^-M^+$, —$N(R^{36})_2$, and —$N^+(R^{36})_3X^-$ wherein each $R^{36}$ is independently hydrogen, $C_1$–$C_6$ alkyl, —$(CH_2)_nOH$, —$(CH_2CH_2O)_nH$, and mixtures thereof; wherein n is from 1 to 4; preferably hydrogen $C_1$–$C_6$ alkyl, —$CO_2^-M^+$, —$SO_3^-M^+$, —$OSO_3^-M^+$, and mixtures thereof, more preferably $R^{34}$ or $R^{35}$ is hydrogen and the other moiety is $C_1$–$C_6$; wherein M is a water soluble cation and X is chlorine, bromine, iodine, or other water soluble anion. Examples of other water soluble anions include organic species such as fumarate, tartrate, oxalate and the like, inorganic species include sulfate, hydrogen sulfate, phosphate and the like;

o) alkyleneoxyaryl and substituted alkyleneoxyarylalkyleneoxyaryl units are defined as moieties having the formula:

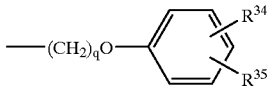

wherein $R^{34}$ and $R^{35}$ are independently selected from the group consisting of hydrogen, $C_1$–$C_6$ alkyl, $C_2$–$C_6$ alkenyl, $C_1$–$C_6$ alkoxy, $C_3$–$C_6$ branched alkoxy, halogen, morpholino, cyano, nitrilo, —$CO_2^-M^+$, —$SO_3^-M^+$, —$OSO_3^-M^+$, —$N(R^{36})_2$, and —$N^+(R^{36})_3X^-$ wherein each $R^{36}$ is independently hydrogen, $C_1$–$C_6$ alkyl, —$(CH_2)_nOH$, —$(CH_2CH_2O)_nH$, and mixtures thereof; wherein n is from 1 to 4; preferably hydrogen $C_1$–$C_6$ alkyl, —$CO_2^-M^+$, —$SO_3^-M^+$, —$OSO_3^-M^{30}$, and mixtures thereof, more preferably $R^{34}$ or $R^{35}$ is hydrogen and the other moiety is $C_1$–$C_6$; wherein M is a water soluble cation and X is chlorine, bromine, iodine, or other water soluble anion. Examples of other water soluble anions include organic species such as fumarate, tartrate, oxalate and the like, inorganic species include sulfate, hydrogen sulfate, phosphate and the like; q is from 0 to about 10 preferably from about 1 to about 3;

p) oxyalkylenearyl and substituted oxyalkylenearyl having the formula:

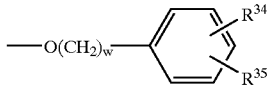

wherein $R^{34}$ and $R^{35}$ are independently selected from the group consisting of hydrogen, $C_1$–$C_6$ alkyl, $C_2$–$C_6$ alkenyl, $C_1$–$C_6$ alkoxy, $C_3$–$C_6$ branched alkoxy, halogen, morpholino, cyano, nitrilo, —$CO_2^-M^+$, —$SO_3^-M^+$, —$OSO_3^-M^+$, —$N(R^{36})_2$, and —$N^+(R^{36})_3X^-$ wherein each $R^{36}$ is independently hydrogen, $C_1$–$C_6$ alkyl, —$(CH_2)_nOH$, —$(CH_2CH_2O)_nH$, and mixtures thereof; wherein n is from 1 to 4; preferably hydrogen $C_1$–$C_6$ alkyl, —$CO_2^-M^+$, —$SO_3^-M^+$, —$OSO_3^-M^+$, and mixtures thereof, more preferably $R^{34}$ or $R^{35}$is hydrogen and the other moiety is $C_1$–$C_6$; wherein M is a water soluble cation and X is chlorine, bromine, iodine, or other water soluble anion. Examples of other water soluble anions include organic species such as fumarate, tartrate, oxalate and the like, inorganic species include sulfate, hydrogen sulfate, phosphate and the like; w is from 1 to about 10, preferably from about 1 to about 3;

q) $C_1$–$C_{22}$ thioalkyl, $C_3$–$C_{22}$ substituted thioalkyl, and mixtures thereof;

r) alkyleneamino units having the formula:

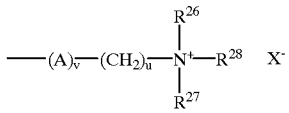

wherein $R^{26}$, and $R^{27}$ are each a $C_1$–$C_{22}$ alkyl, $C_3$–$C_{22}$ branched alkyl, $C_2$–$C_{22}$ alkenyl, $C_3$–$C_{22}$ branched alkenyl, $R^{28}$ is hydrogen, $C_1$–$C_{22}$ alkyl, $C_4$–$C_{22}$ branched alkyl, $C_3$–$C_{22}$ alkenyl, $C_4$–$C_{22}$ branched alkenyl and mixtures thereof, A is the heteroatom nitrogen or oxygen, preferably A is oxygen, the index v is 0 when the heteroatom is absent, v is equal to 1 when the heteroatom is present, preferably v is equal to 0; X is chloride, bromide, iodide, or other water soluble anion, u is from 0 to 22, preferably u is from 3 to about 10. Examples of other water soluble anions include organic species such as fumarate, tartrate, oxalate and the like, inorganic species include sulfate, hydrogen sulfate, phosphate and the like;

s) an amino unit of the formula $$—NR^{29}R^{30}$$

wherein $R^{29}$ and $R^{30}$ comprises $C_1$–$C_{22}$ alkyl, $C_3$–$C_{22}$ branched alkyl, $C_2$–$C_{22}$ alkenyl, $C_3$–$C_{22}$ branched alkenyl, and mixtures thereof;

t) alkylethyleneoxy units having the formula:

$$—(A)_k—(CH_2)_m(OCH_2CH_2)_nZ$$

wherein A is the heteroatom nitrogen or oxygen, preferably A is oxygen, the index k is 0 when the heteroatom is absent, k is equal to 1 when the heteroatom is present, Z is hydrogen, hydroxyl, $C_1$–$C_{30}$ alkoxy, aryl, substituted aryl, aryloxy, substituted aryloxy, alkyleneamino, $—SO_3^-M^+$, $—OSO_3^-M^+$, $—CO_2M$, $—CH_2CO_2M$, and mixtures thereof, preferably hydrogen or $C_1$–$C_{30}$ alkoxy; n is from 1 to 100, preferably from 0 to about 20, more preferably from 2 to about 10; and m is from 1 to 12, preferably from about 1 to about 5;

u) carboxylate of the formula

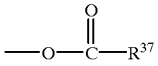

wherein $R^{37}$ comprises:

i) $C_1$–$C_{22}$ alkyl, $C_3$–$C_{22}$ branched alkyl, $C_2$–$C_{22}$ alkenyl, $C_3$–$C_{22}$ branched alkenyl, and mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, and mixtures thereof;

iii) poly-hydroxyl substituted $C_3$–$C_{22}$ alkyl;

iv) $C_3$–$C_{22}$ glycol;

v) $C_1$–$C_{22}$ alkoxy;

vi) $C_3$–$C_{22}$ branched alkoxy;

vii) substituted aryl, unsubstituted aryl, or mixtures thereof;

viii) substituted alkylaryl, unsubstituted alkylaryl, or mixtures thereof;

ix) substituted aryloxy, unsubstituted aryloxy, or mixtures thereof;

x) substituted alkoxy, unsubstituted alkoxyaryl, or mixtures thereof;

xi) substituted alkyleneoxyaryl, unsubstituted alkyleneoxyaryl, of mixtures thereof;

xii) alkyleneamino; and mixtures thereof;

v) siloxy and substituted siloxy of the formula $—OSiR^{31}R^{32}R^{33}$ wherein each $R^{31}$, $R^{32}$, and $R^{33}$ is independently selected from the group consisting of $C_1$–$C_8$ alkyl, $C_3$–$C_8$ branched alkyl, $C_2$–$C_8$ alkenyl, $C_3$–$C_8$ branched alkenyl, substituted alkyl, aryl, alkylethyleneoxy units of the formula $$—(A)_k—(CH_2)_m(OCH_2CH_2)_nZ$$

wherein Z is hydrogen, $C_1$–$C_{30}$ alkyl, hydroxyl, $—CO_2H$, $—SO_3^-M^+$, $—OSO_3^-M^+$, $C_1$–$C_6$ alkoxy, aryl, substituted aryl, aryloxy, substituted aryloxy alkyleneamino; and mixtures thereof; A units comprise nitrogen or oxygen, M is a water soluble cation, k is 0 or 1, n is from 0 to 100, m is from 0 to 12; and mixtures thereof; and, alkyleneamino units and mixtures thereof.

According to the present invention the preferred axial R units comprise moieties having the formula $$—Y_i—L_j \text{ and } —Y_i—Q_j$$

wherein Y is a linking moiety selected from the group consisting of O, $CR^{41}R^{42}$, $OSiR^{41}R^{42}$, $OSnR^{41}R^{42}$, and mixtures thereof; wherein $R^{41}$ and $R^{42}$ are hydrogen, $C_1$–$C_4$ alkyl, halogen, and mixtures thereof; i is 0 or 1, j is from 1 to 3;

L is a ligand selected from the group consisting of:

a) $C_3$–$C_{30}$ linear alkyl, $C_3$–$C_{30}$ branched alkyl, $C_2$–$C_{30}$ linear alkenyl, $C_3$–$C_{30}$ branched alkenyl, $C_6$–$C_{20}$ aryl, $C_7$–$C_{20}$ arylalkyl, $C_7$–$C_{20}$ alkylaryl, and mixtures thereof;

b) an alkylethyleneoxy unit of the formula $$—(R^{39})_y(OR^{38})_xOZ$$

wherein Z is selected from the group consisting of hydrogen, $C_1$–$C_{20}$ alkyl, $C_3$–$C_{20}$ branched alkyl, $C_2$–$C_{20}$ linear alkenyl, $C_3$–$C_{20}$ branched alkenyl, $C_6$–$C_{20}$ aryl, $C_7$–$C_{30}$ arylalkyl, $C_6$–$C_{20}$ alkylaryl, and mixtures thereof; $R^{38}$ is selected from the group consisting of $C_1$–$C_4$ linear alkylene, $C_3$–$C_4$ branched alkylene, $C_3$–$C_6$ hydroxyalkylene, and mixtures thereof; $R^{39}$ is selected from the group consisting of $C_2$–$C_{20}$ alkyl, $C_6$–$C_{20}$ branched alkyl, $C_7$–$C_{20}$ aryl, $C_7$–$C_{30}$ arylalkyl, $C_7$–$C_{30}$ alkylaryl, and mixtures thereof; x is from 1 to 100; y is 0 or 1; and Q is an ionic moiety having the formula:

$$—R^{40}—P$$

wherein $R^{40}$ is selected from the group consisting of $C_3$–$C_{30}$ linear alkylene, $C_3$–$C_{30}$ branched alkylene, $C_2$–$C_{30}$ linear alkenylene, $C_3$–$C_{30}$ branched alkenylene, $C_6$–$C_{16}$ arylene, and mixtures thereof; P is selected from the group consisting of $—CO_2^-M^+$, $—SO_3^-M^+$, $—OSO_3^-M^+$; $PO_3^{231}$ $M^+$, $—OPO_3^-M^+$, $—N^+(R^{36})_3X^-$; M is a water soluble cation of sufficient charge to provide electronic neutrality and X is a water soluble anion as defined herein above. Preferred axial R units are alkyl alkyleneoxy units of the formula $$—(R^{39})_y(OR^{38})_xOZ$$

wherein Z is selected from the group consisting of hydrogen, $C_3$–$C_{20}$ linear alkyl, $C_3$–$C_{20}$ branched alkyl, $C_2$–$C_{20}$ linear alkenyl, $C_3$–$C_{20}$ branched alkenyl, $C_6$–$C_{10}$ aryl, $C_7$–$C_{20}$ arylalkyl, $C_7$–$C_{20}$ alkylaryl, and mixtures thereof; $R^{38}$ is selected from the group consisting of $C_1$–$C_4$ linear alkylene, $C_3$–$C_4$ branched alkylene, and mixtures thereof; $R^{39}$ is selected from the group consisting of $C_2$–$C_6$ alkylene, $C_3$–$C_6$ branched alkylene, $C_6$–$C_{10}$ arylene, and mixtures thereof; x is from 1 to 50; y is 0 or 1.

More preferred axial R units comprise y equal to 0, Z is hydrogen, $C_1$–$C_{20}$ alkyl, $C_3$–$C_{20}$ branched alkyl, $C_6$–$C_{10}$ aryl, and mixtures thereof, most preferred Z is hydrogen or $C_6$–$C_{20}$ linear alkyl, $C_{10}$–$C_{20}$ branched alkyl; $R^{38}$ is $C_1$–$C_4$ linear or $C_3$–$C_4$ branched alkylene.

Also preferred R units having the formula:

$$—Y_i—Q_j$$

wherein Y is a linking moiety selected from the group consisting of O, $CR^{41}R^{42}$, $OSiR^{41}R^{42}$, $OSnR^{41}R^{42}$, and mixtures thereof; i is 0 or 1, j is from 1 to 3; Q is an ionic moiety having the formula:

$$—R^{40}—P$$

wherein $R^{40}$ is selected from the group consisting of $C_3$–$C_{20}$ linear alkyl, $C_3$–$C_{20}$ branched alkyl, $C_2$–$C_{20}$ linear alkenyl, $C_3$–$C_{20}$ branched alkenyl, $C_6$–$C_{10}$ aryl, and mixtures thereof; P is selected from the group consisting of $—CO_2^-M^+$, $—SO_3^-M^+$, $—OSO_3^-M^+$; $PO_3^{2-}M^+$, $—OPO_3^-M^+$, $—N^+(R^{36})_3X^-$; wherein $R^{36}$ is independently hydrogen, $C_1$–$C_6$ alkyl, $—(CH_2)_nOH$, $—(CH_2CH_2O)_nH$, and mixtures thereof; wherein n is from 1 to 4; M is a water soluble cation of sufficient charge to provide electronic neutrality and X is a water soluble anion as defined herein above.

A preferred hydrophilic R has the index i equal to 1; $R^{40}$ is $C_3$–$C_{20}$ linear alkyl, $C_3$–$C_{20}$ branched alkyl; P is $—CO_2^-M^+$, $—SO_3^-M^+$, $—OSO_3^-M^+$; M is a water soluble cation of sufficient charge to provide electronic neutrality.

Examples of Y units suitable for use in R units having the formula:

$$—Y_i—L_j$$

have the formula $$—O—L^1,\ —Sn—L^1,\ —OSn—L^1$$

wherein i is equal to 1 and j is equal to 1. Further examples have the formula

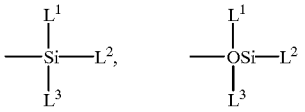

wherein i is equal to 1 and j is equal to 3. The above examples also apply to Y units when used with Q ionic moieties.

The following example illustrates a cyanine ring, which chelates a metal or non-metal atom,in this case silicon, and having the balance of the central atom's valences bonded to axial R units:

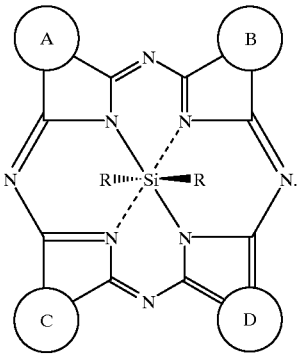

The present invention relates to process for bleaching or removing stains from textiles, organic or inorganic substrates or for protecting the latter against attack by microorganisms, wherein the textiles or the substrates to be freed from or protected against micro-organisms, are treated with the photosensitizing compounds of the present invention, in the presence of water and while being irradiated by light.

The present invention relates to photobleaching compositions suitable for use as laundry detergent compositions.

The photobleaching compositions according to the present invention comprise:

A) at least about 0.001 ppm, preferably from about 0.01 to about 10000 ppm, more preferably from about 0.1 to about 5000 ppm, most preferably form about 10 to about 1000 ppm, of hybrid cyanine photosensitizing compounds, said compounds comprising a mixture of hybrid cyanine ring chelates having the formula:

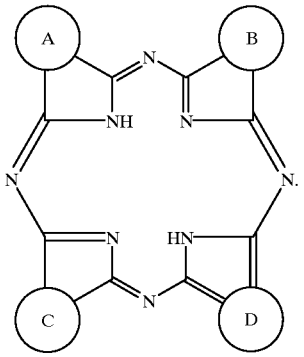

wherein rings A, B, C, and D are aromatic rings independently selected from the group consisting of substituted and unsubstituted benzene, substituted and unsubstituted naphthalene, substituted and unsubstituted anthracene, substituted and unsubstituted phenanthrene, and mixtures thereof; and B) the balance carriers and other adjunct ingredients, preferably the adjunct ingredients are selected from the group consisting of, but not limited to, buffers, builders, chelants, filler salts, soil release agents, dispersants, enzymes, enzyme boosters, perfumes, thickeners, clays, bleaches, solvents, and mixtures thereof.

A more preferred photobleaching composition contains a photosensitizing compound that further comprises a photoactive metal. The photobleaching compositions according to the present invention which comprise metallocyanines comprise:

A) at least about 0.001 ppm, preferably from about 0.01 to about 10000 ppm, more preferably from about 0.1 to about 5000 ppm, most preferably form about 10 to about 1000 ppm, of a hybrid metallocyanine photosensitizing mixture, the mixture comprising two or more, preferably from about 3 to about 100, more preferably from about 10 to about 100 hybrid compounds having the formula:

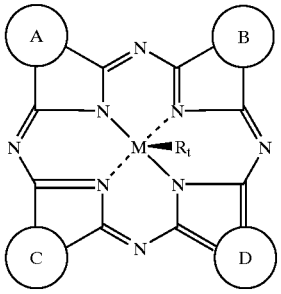

wherein each metallocyanine of the mixture comprises:

a) a photoactive metal or non-metal M wherein said photoactive metal or non-metal M is selected from the group consisting of silicon, germanium, tin. lead, aluminum, platinum, palladium, phosphorous, and mixtures thereof, provided said metal or non-metal has a valence of the or four;

b) aromatic rings A, B, C, and D wherein each ring is independently selected from the group consisting of substituted or unsubstituted benzene, 1,2-naphthalene, 2,3-naphthalene, anthracene, phenathrene, and mixtures thereof; and c) solubility and substantivity mediating axial R units; t has the value of 1 or 2;

provided each photosensitizer of said mixture has a Q-band maximum absorption wavelength of 600 nm or greater, said metallocyanines described herein;

B) at least about 0.1%, preferably from about 0.1% to about 30%, more preferably from about 1% to about 30%, most preferably from about 5% to about 20% by weight, of a detersive surfactant, said detersive surfactant is selected from the group consisting of anionic, cationic, nonionic, zwitterionic, ampholytic surfactants, and mixtures thereof; and C) the balance carriers and other adjunct ingredients said adjunct ingredients are selected from the group consisting of buffers, builders, chelants, filler salts, soil release agents, dispersants, enzymes, enzyme boosters, perfumes, thickeners, clays, bleaches, solvents, and mixtures thereof.

The present invention therefore relates to a method for photobleaching a fabric comprising the step of contacting a fabric in need of cleaning with an aqueous cleaning solution comprising at least 0.001 ppm of the photosensitizing composition according to the present invention followed by exposing the surface of the treated fabric to a source of light having a minimal wavelength range from about 300 to about 1200 nanometers.

Typically the source of light is sunlight and the fabric after treatment with a solution comprising a photosensitizer according to the present invention is exposed to the sunlight by hanging the fabric in the open air. The light source can also be provided during the course of laundering with a photobleaching solution. For example, a washing machine may be adapted to include a light source having a suitable wavelength range, preferably from about 300 to about 1200 nanometers.

The intensity of the illumination can vary within wide limits, and it depends both on the concentration of active substrate as well as the nature of the light source as to the photobleaching efficiency of any particular compound of the present invention. A further parameter which can be varied is the exposure time, i.e. for the same effect exposure must be longer at a lower light intensity than at a higher intensity. In general, depending on the field of use, exposure time of a few minutes up to a few hours is possible.

If the process is carried out in an aqueous medium (for example the sterilization of textiles), the irradiation with light can either be carried out directly in the treatment medium, by means of an artificial source of light mounted inside or outside the medium, or the articles, in a moist state, can subsequently either be irradiated, again by means of an artificial source of light, or can be exposed to sunlight. Good antimicrobial effects can be achieved even with very low concentrations of active substance, for example at 0.001 ppm. Depending on the field of use and on the hybrid cyanine photosensitizing derivatives employed, a concentration between 0.005 and 2000, preferably 0.01 and 1000 ppm.

The present invention further relates to a method for photodisinfecting a surface comprising the step of contacting a surface in need of cleaning with an aqueous cleaning solution comprising at least 0.001 ppm of the photosensitizing composition according to the present invention followed by exposing the treated surface to a source of light having a suitable wavelength range, preferably from about 300 to about 1200 nanometers.

The methods of the present invention can also be accomplished in solvent based carriers or in low aqueous solutions. For the purpose of the present invention the term, low aqueous means that water is added to a carrier system to modify the properties of the carrier and not solely for the purpose of solublizing the substrate. For example, solvents that are capable of holding solublized oxygen as well as forming a miscible system with water are preferred. Non-limiting examples of these solvents are butoxy propoxy propanol (BPP), methoxy propoxy propanol (MPP), ethoxy propoxy propanol (EPP), and propoxy propoxy propanol (PPP). Embodiments of the present invention which comprise these non-classical aqueous compositions are most useful when the photobleach must be applied to a woven fabric or surface that contains agents which repel water and moisture.

The sterilization of textiles of synthetic or natural original may be mentioned as an important application. Thus, material to be washed in the household or in industry can be disinfected by means of the methods of the present invention. The material to be washed can be treated for this purpose in the manner mentioned above with aqueous solutions of the hybrid cyanines of the present invention while being irradiated with light. The hybrid cyanines can advantageously be present in the treatment medium in a concentration of from 0.01 to about 2000 mg per liter, preferably from 0.1 to 1000, more preferably from 0.1 to 500. The sterilization can be carried out advantageously together with the washing process. For this purpose, the material to be washed is treated with a wash medium containing customary detergent substances, one or more hybrid cyanines according to the present invention and, if desired, inorganic salts and/or other adjunct materials. The washing process con be carried out manually, for example in a tub, or can be carried out in a washing machine. The necessary exposure to light can be effected during the washing process by means of suitable light sources, or the moist material being washed can also, subsequently, for example during drying, either be exposed to a suitable artificial source of light or simply exposed to sunlight, for example line drying.

Surface bleaching can be achieved, for example by applying to the appropriate surface, an aqueous solution of the hybrid cyanine photosensitizing compounds according to the present invention, this solution preferably comprising from about 0.001 to about 10%, by weight of active substance. The solution can also comprise, in addition, other customary additives, for example wetting agents, dispersing agents or emulsifiers, detergent substances and, if desired inorganic salts. After this solution has been applied, the surface is simply exposed to sunlight or, if required, it can in addition be irradiated by means of an artificial source of light. It is advisable to keep the surface moist during the exposure to light.

The hybrid photosensitizers of the present invention can be modified to have a wide range of surface affinities. Molecules can be made "substantive" or "non-substantive" by the choice of axial R units. The term "substantivity" as defined herein is the property which allows the photobleaching agent to successfully contact a particular targeted surface. For example, the axial groups R, hereinafter defined in the specification, may be selected to provide compatibility of the photobleaching compound with a synthetic fabric, a durable surface such as ceramic tile, or in general any fabric, article of manufacture or situs that is to be a target of photobleaching.

For example, the R unit is matched to the structural properties of either the targeted material (i.e. fabric) or to the targeted substrate (i.e. stain). The option to tailor the properties of the R unit is due to the ability to select R units independently of effecting the hybrid cyanine ring thereby leaving the photophysics unaffected.

An additional benefit of the photosensitizers and of the photobleaching systems of the present invention is that they are generally more fabric and color safe than conventional bleaches (i.e. hypochlorite). Without being limited by theory it is believed that the improved fabric and color safety is due to quenching of singlet oxygen by dyestuffs used in the manufacture of colored articles.

"Non-substantive" molecules are desirable for applications where the photosensitizing compound must remain in the liquor rather than becoming attracted to a particular surface, i.e. water sterilization.

Low hue photobleaches and photodisinfectants are a preferred example of the present invention. The term "low hue" as used herein and throughout the specification refers to photobleaches that have a $\lambda_{max}$ of their Q-band above about 700 nm and are therefore only slightly perceptible to the human eye. Those additional materials of the present invention having Q-band maximum wavelengths in the "visible" range, (i.e. 660– 700 nanometers) are photodisinfecting materials that are most suitable when the perception of a colored material is not a factor in deterring utility.

The hybrid cyanines of the present invention will have multiple Q-bands (a separate Q-band for each individual hybrid cyanine ring). This is unlike typical photosensitizing solution which have one Q-band that is responsible for the color. Depending upon the choice of monomers, the Q-band peaks may be spread relatively evenly across the spectral band or the peaks may be clumped together. The final optical properties is therefore at the discretion of the formulator.

Effective photobleaching is predicated on the production of a molecule of singlet oxygen, a theory which has been extensively studied and is well understood by those skilled in the art of photobleaching. Because the singlet oxygen species is short-lived, having the photosensitizing molecule in proximity to the stain to be "attacked" is a primary advantage.

The molecules of the present invention because of the ability of the formulator to control "substantivity" can be directed to any desired situs. The additional ability to prevent layering and stacking of photosensitizing molecules due to the axial nature of the R units, provides for an efficient mono-layer. For example, an embodiment of the present invention for removing stains from a fabric will have the requirements that the hybrid cyanine photosensitizing compounds have an affinity for the fabric surface and that the photobleaching compounds be close to the desired site of action. These requirements are achieved by manipulation of one or more R units.

It has long been known that phthalocyanine and naphthalocyanine rings, can absorb light quanta and form electronically excited species (singlet and triplet) and that these species can be quenched by oxygen to yield 'excited oxygen species'. A particularly preferred 'excited oxygen species' is singlet oxygen which is most reliably formed by the quenching of the triplet state of a photosensitizer, such as a phthalocyanine, by molecular oxygen. It is therefore an aim of the hybrid cyanine photobleach formulator to produce compounds that favor the formation of the triplet state.

When a photosensitizer is irradiated with light, the singlet energy state that results undergoes a variety of processes i.e. re-emission of light (fluorescence). The most important process with regard to photobleaching via singlet oxygen is inter system crossing (ISC). This is the mechanism by which the singlet state is converted to the triplet state. In general, the efficiency of this process is discussed in terms of quantum yield, i.e. the number of photons absorbed that lead to the desired triplet excited state. The present invention provides for increased photobleaching by modifying the efficiency of inter system crossing from the singlet state to the triplet state. The molecules of the present invention, can be modified by the formulator to increase the quantum efficiency by which the triplet state is formed. Surprisingly, the formulator can manipulate the type or cyanine ring monomers as well as the monomer ring substituents to increase triplet quantum yield by, for instance, the "heavy atom effect", a term familiar to those skilled in the art. The selection of a moiety for its "heavy atom effect" can be made independently of other factors, for example, without undue concern for solubility factors. This is because the choice of axial R groups for solubility will have no bearing on the changes made to the hybrid cyanine ring system.

The laundry compositions of the present invention optionally comprise detersive surfactants, examples of which are, anionic, cationic, nonionic, amphoteric and zwitterionic, however the formulator is not limited to these examples or combinations thereof. The surfactants are present from about 0% to about 95%, preferably from about 5% to about 30%, by weight of the composition.

The cleaning compositions of the present invention optionally comprise detersive surfactants, examples of which are, anionic, cationic, nonionic, amphoteric and zwitterionic, however the formulator is not limited to these examples or combinations thereof. The surfactants are present from about 0% to about 50%, preferably from about 5% to about 30%, by weight of the composition.

The laundry compositions of the present invention optionally contains builders, examples of which are, silicates, carbonates, and zeolites, however the user is not limited to these examples or combinations thereof. The builders are present from about 0% to about 50%, preferably from about 5% to about 30%, by weight of the composition.

The cleaning compositions of the present invention optionally contains builders, examples of which are, silicates, carbonates. and zeolites, however the user is not limited to these examples or combinations thereof. The builders are present from about 0% to about 50%, preferably from about 5% to about 30%, by weight of the composition.

The hard surface cleaner of the present invention optionally contains builders, examples of which are, silicates, carbonates. and zeolites, however the user is not limited to these examples or combinations thereof The builders are present from about 0% to about 50%, preferably from about 5% to about 30%, by weight of the composition.

The hard surface cleaner of the present invention optionally contains abrasives from about 0.5% to about 85%, preferably from about 10% to about 85%, by weight of the composition. Suitable abrasives are silicates. carbonates, perlite, clay, and pulverized ceramic clay, however, the user is not restricted to these examples or combinations thereof.

The present invention also relates to a process wherein one or more hybrid cyanine compounds in the presence of oxygen, are brought into contact with the medium in which or on which the said reaction is to take place, or are incorporated in this medium, and are irradiated with light.

If the method is carried out in an aqueous medium (for example the sterilization of textiles), the irradiation with light can either be carried out directly in the treatment medium by means of an artificial source of light mounted inside or outside the medium or the substrates, in a moist state, can subsequently either be irradiated, again by means of an artificial source of light, or can be exposed to sunlight. Good antimicrobial effects of the present compounds can be achieved even with very low concentrations of active substance, for example at 0.001 ppm. Depending on the field of use and on the phthalocyanine or naphthylocyanine derivative employed, a concentration between 0.005 and 100, preferably 0.01 and 50 ppm is preferable.

Substances which increase the action can also be added in the process according to the invention, inter alia electrolytes, for example inorganic salts, for instance sodium chloride, potassium chloride, sodium sulfate, potassium sulfate, sodium acetate ammonium acetate, alkali metal phosphates and alkali metal tri- polyphosphates, especially sodium chloride and sodium sulfate. These salts can be added to the agents according to the invention or can be added directly in the application method, so that they are present in the application solution in a concentration of, preferably 0.1 to 10%, by weight.

What is meant by the term aqueous solution is a solution that is essentially water, however the formulator may include adjunct materials as well as a surfactant to aid in removal of the "treated" micro organisms during rinsing or subsequent cleaning.

Surfactant—The instant cleaning compositions contain from about 0.1% to about 60% by weight of a surfactant selected from the group consisting of anionic, nonionic, ampholytic and zwitterinonic surface active agents. For liquid systems, surfactant is preferably present to the extent of from about 0.1% to 20% by weight of the composition. For solid (i.e. granular) and viscous semi-solid (i.e. gelatinous, pastes, etc.) systems, surfactant is preferably present to the extent of from about 1.5% to 30% by weight of the composition.

Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing; $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are described further herein and are listed in standard texts.

Anionic surfactants can be broadly described as the water-soluble salts, particularly the alkali metal salts, of organic sulfuric reaction products having in their molecular structure an alkyl radical containing from about 8 to about 22 carbon atoms and a radical selected from the group consisting of sulfonic acid and sulfuric acid ester radicals. ( Included in the term alkyl is the alkyl portion of higher acyl radicals.) Important examples of the anionic synthetic detergents which can form the surfactant component of the compositions of the present invention are the sodium or potassium alkyl sulfates, especially those obtained by sulfating the higher alcohols (C8–8 carbon atoms) produced by reducing the glycerides of tallow or coconut oil; sodium or potassium alkyl benzene sulfonates, in which the alkyl group contains from about 9 to about 15 carbon atoms, (the alkyl radical can be a straight or branched aliphatic chain); sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid ester of the reaction product of one mole of a higher fatty alcohol (e.g. tallow or coconut alcohols) and about 1 to about 10 moles of ethylene oxide; sodium or potassium salts of alkyl phenol ethylene oxide ether sulfates with about 1 to about 10 units of ethylene oxide per molecule and in which the alkyl radicals contain from 8 to 12 carbon atoms; the reaction products of fatty acids are derived from coconut oil sodium or potassium salts of tatty acid amides of a methyl tauride in which the fatty acids, for example, are derived from coconut oil and sodium or potassium beta-acetoxy- or beta-acetamido-alkanesulfonates where the alkane has from 8 to 22 carbon atoms.

Additionally, secondary alkyl sulfates may be used by the formulator exclusively or in conjunction with other surfactant materials and the following identifies and illustrates the differences between sulfated surfactants and otherwise conventional alkyl sulfate surfactants. Non-limiting examples of such ingredients are as follows.

Conventional primary alkyl sulfates (LAS), such as those illustrated above, have the general formula ROSO3–M+ wherein R is typically a linear C8–22 hydrocarbyl group and M is a water solublizing cation, for example sodium LAS.

Branched chain primary alkyl sulfate surfactants (i.e., branched-chain "PAS") having 8–20 carbon atoms are also know; see, for example, Eur. Pat. Appl. 439,316, Smith et al., filed Jan. 21, 1991.

Conventional secondary alkyl sulfate surfactants are those materials which have the sulfate moiety distributed randomly along the hydrocarbyl "backbone" of the molecule. Such materials may be depicted by the structure $$CH_3(CH_2)_n(CHOSO_3^-M^+)(CH_2)_mCH_3$$

wherein m and n are integers of 2 of greater and the sum of m+n is typically about 9 to 17, and M is a water-solublizing cation.

The aforementioned secondary alkyl sulfates are those prepared by the addition of $H_2SO_4$ to olefins. A typical synthesis using alpha olefins and sulfuric acid is disclosed in U.S. Pat. No. 3,234,258, Morris, issued Feb. 8, 1966 or in U.S. Pat. No. 5,075,041, Lutz, issued Dec. 24, 1991. The synthesis conducted in solvents which afford the secondary (2,3) alkyl sulfates on cooling, yields products which, when purified to remove the unreacted materials, randomly sulfated materials, unsulfated by-products such as C10 and higher alcohols, secondary olefin sulfonates, and the like, are typically 90+% pure mixtures of 2- and 3-sulfated materials (some sodium sulfate may be present) and are white, non tacky, apparently crystalline, solids. Some 2,3-disulfates may also be present, but generally comprise no more than 5% of the mixture of secondary (2,3) alkyl mono-sulfates. Such materials are available as under the name "DAN", e.g., "DAN 200" from Shell Oil Company.

Bleaching Agents and Bleach Activators—The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches other than the hypohalite (e.g. hypochlorite) bleaches. Perborate (e.g., mono- or tetrahydrate sodium salts) and percarbonate bleaches can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

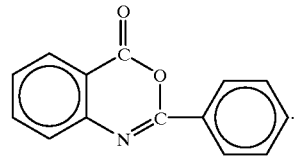

Still another class of preferred bleach activators includes the acyl lactam activators, especially acyl caprolactams and acyl valerolactams of the formulae:

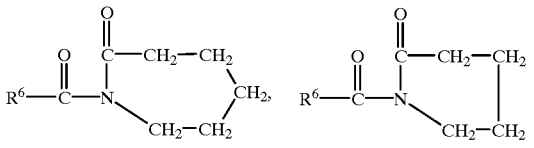

wherein $R^6$ is H or an alkyl, aryl, alkoxyaryl, or alkaryl group containing from 1 to about 12 carbon atoms. Highly preferred lactam activators include benzoyl caprolactan, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

Buffers—Buffers can be included in the formulations herein for a variety of purposes. One such purpose is to adjust the cleaning surface pH to optimize the hard surface cleaner composition effectiveness relative to a particular type of soil or stain. Buffers may be included to stabilize the adjunct ingredients with respect to extended shelf life or for the purpose of maintaining compatibility between various aesthetic ingredients. The hard surface cleaner of the present invention optionally contains buffers to adjust the pH in a range from about 7 to about 13, preferably from about 8 to about 13, more preferably from about 10 to about 11. Non-limiting examples of such suitable buffers are potassium carbonate, sodium carbonate, and sodium bicarbonate, however, the formulator is not restricted to these examples or combinations thereof.

Adjunct Materials

The compositions herein can optionally include one or more other detergent adjunct materials or other materials for assisting or enhancing cleaning performance, treatment of the surface to be cleaned, or to modify the aesthetics of the composition (e.g., perfumes, colorants, dyes, etc.). The following are illustrative examples of such adjunct materials but are not meant to be exclusive or limiting in scope.

Chelating Agents—The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions Inert Salts. The inert salts (filler salts) used in the compositions of the present invention can be any water-soluble inorganic or organic salt or mixtures of such salts which do not destabilize the surfactant. For the purposed of the present invention, "water-soluble" means having a solubility in water of at least 1 gram per 100 grams of water at 20° C. Examples of suitable salts include various alkali metal and/or alkali earth metal sulfate, chlorides, borates, bromides, fluorides, phosphates, carbonates, bicarbonates, citrates, acetates, lactates, etc.

Specific examples of suitable salts include sodium sulfate, sodium chloride, potassium chloride, sodium carbonate, potassium sulfate, lithium chloride, lithium sulfate, tripotassium phosphate, sodium borate, potassium bromide, potassium fluoride, sodium bicarbonate, magnesium sulfate, magnesium chloride, sodium citrate, sodium acetate, magnesium lactate, sodium fluoride. The preferred salts are inorganic salts preferably the alkali metal sulfates and chlorides. Particularly preferred salts, because of their low cost are sodium sulfate and sodium chloride. The salts are present in the compositions at levels of from 0% to 40%, preferably 10% to 20%.

Abrasives. An essential component of many solid or viscous semi-solid hard surface cleaning compositions is the abrasive material added to facilitate the action of scouring. Abrasive scouring cleansers provide a convenient and useful means for carrying out the sanitizing of porcelain and tile surfaces, especially tubs, showers and toilet bowls. The particulate abrasive material within such compositions serves to abrade and loosen soil adhering to hard surfaces and further serves to create more intimate contact between hard surface stain and the surfactant and/or bleaching agents also present in the cleansing compositions.

Abrasive cleaners have traditionally contained water-insoluble, relatively hard, particulate mineral material as the abrasive agent. The most common such abrasive agent is finely divided silica sand having particle size varying between about 1 and 300 microns and specific gravity of about 2.1 or higher. While such material is generally very effective in scouring soil and stains from the surfaces being treated, abrasive material of this type tends to be difficult to rinse away from the toilet bowl, shower or bathtub surface.

In the case where moderate or highly water soluble abrasive material is required (i.e. sodium carbonate) imidodisulfate can be used as the sole abrasive or otherwise added in part.

It has been discovered that abrasive compositions of this desired type can be realized by utilizing a particular type of expanded perlite abrasive in combination with the surfactants, filler material, and other optional scouring material ingredients listed herein. The abrasive materials suitable to the present invention are those contained in U.S. Pat. No. 4,051,056, Hartman, issued Sept. 27, 1977 and included herein by reference.

Perfumes. Perfumes are an important ingredient especially for the liquid composition embodiment. Perfume is usually used at levels of from 0% to 5%. In U.S. Pat. No. 4,246,129, Kacher, issued Jan. 20, 1981 (incorporated herein by reference), certain perfume materials are disclosed which perform the added function reducing the solubility of anionic sulfonate and sulfate surfactants.

Dyes. Dyes may be include at levels of from abut 0.5% to 12%, preferably 1.5% to 5%. Solids and viscous semi-solids can be made with 1.5% dye and no perfume. Examples of suitable dyes are Alizarine Light Blue B (C.I. 63010), Carta Blue VP (C.I. 24401), Acid Green 2G (C.I. 42085), Astrogen Green D (C.I. 42040), Supranol Cyanine 7B (C.I. 42675, Maxilon Blue 3RL (C.I. Basic Blue 80), Drimarine Blue Z-RL (C.I. Reactive Blue 18), Alizarine Light Blue H-RL (C.I. Acid Blue 182), FD&C Blue No. 1 and FD&C Green No. 3. (See the patents of Kitko, U.S. Pat. No. 4,248,827 issued Feb. 3, 1981 and U.S. Pat. No. 4,200,606, issued Apr. 29, 1980, both incorporated herein by reference.) C.I. refers to Color Index.

Optional Adjuncts Ingredients. As a preferred embodiment, the conventional adjunct ingredients employed herein can be selected from typical components such as enzymes (compatible with the applicable with other adjunct ingredients), especially proteases, lipases, cellulases, color speckles, suds boosters, suds supressors, anti-tarnish and/or anti-corrosion agents, soil-suspending agents, germicides, alkalinity sources, hydrotropes, anti-oxidants, enzyme stabilizing agents, solvents, clay soil chelating agents will generally comprise from about 0.1% to about 10% by weight of the detergent compositions herein. More preferably, if utilized, the chelating agents will comprise from about 0.1% to about 3.0% by weight of such composition removal/anti-redeposition agents, polymeric dispersing agents, dye transfer inhibiting agents, including polyamine N-oxides such as polyvinylpyrrolidone and copolymers of N-vinyl imidazole and N-vinyl pyrrolidone, etc.

EXAMPLE 1

Preparation of 1:3 silicon(IV)phthalo/naphthalocyanine dichloride

To a mixture of 1,3-diiminoisoindoline (0.333 g, 2.3 mmole), 1,3-diiminobenz[f]-isoindoline (1.35 g, 6.9 mmole) and anhydrous quinoline (15 mL) under argon is added silicon tetrachloride (2.21 g, 12.9 mmole). The mixture is placed in an oil bath pre-heated to 60° C., held for 30 minutes at that temperature, slowly heated to reflux over a period of 30 minutes, held at reflux for 30 minutes, then is allowed to cool over 1 hour. Methanol (10 mL) is added and the reaction solution is allowed to stand at room temperature for 24 hours. The green solid that results is collected by filtration, rinsed twice with 10 mL portions of methanol, dried in vacuo at 120° C. and used without further purification.

EXAMPLE 2

Preparation of 1:2 silicon(IV)phthalo/naphthalocyanine dichloride

The above procedure is suitable for use in preparing 1:2 silicon(IV)phthalo-naphthalocyanine dichloride using the following reagents in the indicated amounts; 1,3-diiminoisoindoline (0.333 g, 2.3 mmole), 1,3-diiminobenz [f]-isoindoline(0.944 g, 4.6 mmole), and silicon tetrachloride (1.65 g, 9.6 mmole).

EXAMPLE 3

Preparation of 1:1 silicon(IV)phthalo/naphthalocyanine dichloride

The above procedure is suitable for use in preparing 1:1 silicon(IV)phthalo-naphthalocyanine dichloride using the following reagents in the indicated amounts; 1,3 -diiminoisoindoline (0.333 g, 2.3 mmole), 1,3-diiminobenz [f]-isoindoline(0.449, 2.3 mmole), & silicon tetrachloride (1.11 g, 6.44 mmole).

EXAMPLE 4

Preparation of 1:1 dilithium octachlorophthalocyanine/naphthalocyanine

To a solution of 2,3-dicyanonaphthalene (5.0 g, 28.1 mmole) and 4,5-dichlorophthalonitrile (5.54 g, 28.1 mmole) in refluxing anhydrous 1-butanol (200 mL) under a blanket of argon is added lithium shot (1.17 g, 168.6 mmole). The solution is allowed to reflux for 6 hours then diluted with anhydrous methanol (500 mL) and kept at 0° C. for 18 hours. The resulting green solid is collected by filtration, dried in vacuo at 80° C. and used without further purification.

EXAMPLE 5

Preparation of 1:3 dilithium dichlorophthalocyanine/naphthalocyanine

The above procedure is suitable for use in preparing 1:3 dilithium dichlorophthalocyanine/naphthalocyanine using the following reagents in the indicated amounts; 2,3-dicyanonaphthalene (5.0 g, 28.1 mmole), 4,5-dichlorophthalonitrile (1.85 g, 9.67 mmole) & lithium shot (0.79 g, 113.3 mmole).

EXAMPLE 6

Preparation of 1:1 dilithium octabutoxyphthalocyanine/naphthalocyanine

The above procedure is suitable for use in preparing 1:1 dilithium octabutoxyphthalocyanine/naphthalocyanine using the following reagents in the indicated amounts; 2,3-dicyanonaphthalene (5.0 g, 28.1 mmole), 3.6-dibutoxyphthalonitrile (7.65 g, 28.1 mmole) & lithium shot (1.17 g, 168.6 mmole).

EXAMPLE 7

Preparation of 1:3 dilithium octabutoxyphthalocyanine/naphthalocyanine

The above procedure is suitable for use in preparing 1:3 dilithium octabutoxyphthalocyanine/naphthalocyanine using the following reagents in the indicated amounts; 2,3-dicyanonaphthalene (5.0 g, 28.1 mmole). 3.6-dibutoxyphthalonitrile (2.55 g, 9.76 mmole) & lithium shot (0.79 g, 113.3 mmole).

EXAMPLE 8

Preparation of 1:1 dilithium tetrabutoxyphthalocyanine/naphthalocyanine

The above procedure is suitable for use in preparing 1:1 dilithium tetrabutoxyphthalocyanine/naphthalocyanine using the following reagents in the indicated amounts; 2,3-dicyanonaphthalene (5.0 g, 28.1 mmole). 3.6dibutoxyphthalonitrile (5.62 g, 28.1 mmole) & lithium shot (1.17 g, 168.6 mmole).

EXAMPLE 9

Preparation of 1:3 dilithium tetrabutoxyphthalocyanine/naphthalocyanine

The above procedure is suitable for use in preparing 1:3 dilithium tetrabutoxyphthalocyanine/naphthalocyanine using the following reagents in the indicated amounts; 2,3-dicyanonaphthalene (5.0 g, 28.1 mmole), 3,6-dibutoxyphthalonitrile (1.87 g, 9.76 mmole) & lithium shot (0.79 g, 113.3 mmole).

EXAMPLE 10

Preparation of 12phthalocyanines from dilithium phthalocyanines

Phthalocyanines are prepared from dilithium phthalocyanines using the following procedure. To a solution of the dilithium phthalocyanine (2 g) in DMF (200 mL) is added 1N HCl (10 mL). The solution is stirred at room temperature for 1 hour. To this solution is added distilled water (200 mL) over about 30 minutes. The solid phthalocyanine which precipitates is collected by filtration, dried in vacuo at 100° C. and can be used without further purification.

EXAMPLE 11

Preparation of 1:3 silicon(IV)phthalo/naphthalocyanine-di-[poly(ethylene glycol 350) methyl ether]

A mixture of 1:3 silicon(IV)phthalo/naphthalocyanine dichloride (1.0 g, 1.31 mmole), anhydrous poly(ethylene glycol 350) methyl ether (36.78 g, 105.1 mmole) is added to anhydrous DMF (150 mL) and heated to reflux over 3 hours after which the solution is held at reflux for 48 hours under argon. The solution is then cooled to room temperature, the solvent removed in vacuo, and the resulting product is used without further purification.

This procedure is also suitable for use in preparing 1:3 silicon(IV)phthalo-naphthalocyanine-di-(Neodol 23-6.5) and 1:3 silicon(IV)phthalo/naphthalocyanine-di-[glycerol-di-(diethylene glycol methyl ether)].

EXAMPLE 12

Preparation of 1:3 silicon(IV)phthalo/naphthalocyanine-di-(triethanolamine dimethyl sulfate quat)

A mixture of 1:3 silicon(IV)phthalo/naphthalocyanine dichloride (0.5 g, 0.655 mmole) and anhydrous triethanolamine (10 g, 67.04 mmole) are combined in anhydrous DMF (150 mL) and heated to reflux over 1 hour and refluxed an additional 2 hours. The solvent is removed in vacuo and the resulting oil is dissolved in DMF (25 mL) and slowly added to about 800 mL of water to induce crystallization. The resulting green solid is collected by filtration and dried in vacuo at 80° C. The product is then suspended in a solution of dimethyl sulfate (0.24 g, 1.965 mmole) in anhydrous p-dioxane (100 mL) for 18 hours at room temperature. The resulting green solid is collected by filtration, dried and used without further purification. The cleaning compositions provided in accordance with this invention may be in the form of granules, liquids, bars, and the like, and typically are formulated to provide an in-use pH in the range of 9 to 11, however in the case of non-aqueous or low aqueous compositions the pH ranges may vary outside this range. Various carriers such as sodium sulfate, water, water-ethanol, BPP, MPP, EPP, PPP, sodium carbonate, and the like, may be used routinely to formulate the finished products. Granules may be produced by spray-drying or by agglomeration, using known techniques, to provide products in the density range of 350–950 g/l. Bars may be formulated using conventional extrusion techniques. The photobleach-chelant may be preformed, if desired. The compositions may also contain conventional perfumes, bactericides, hydrotropes and the like. In the case of non-aqueous or low aqueous compositions, the cleaning compositions may be applied to an article which is used to deliver the compositions of the present invention to a fabric or to a hard surface. Non-limiting examples of compositions according to this invention are as follows:

EXAMPLES 13–16

| | Weight % | | | |
|---|---|---|---|---|
| Ingredients | 13 | 14 | 15 | 16 |
| Sodium linear alkylbenzene sulfonate | 15 | 30 | 20 | 25 |
| NEODOL | 1 | 1 | 1 | 1 |
| Alkyl dimethyl ammonium chloride | 0.5 | 1 | 0.5 | 0.7 |
| Sodium tripolyphosphate | 15 | 35 | 22 | 28 |
| Sodium carbonate | 10 | 10 | 15 | 15 |
| SOKALAN | 2 | 2 | 2 | 2 |
| Carboxymethylcellulose | 1 | 1 | 1 | 1 |
| Tinopal CBS-X | 0.1 | 0.1 | 0.1 | 0.1 |
| Soil release agent[1] | 0.2 | 0.2 | 0.3 | 0.3 |
| Savinase 6.0T | 0.3 | 0.6 | 0.5 | 0.6 |
| Ban 300T | 0.2 | 0.5 | 0.5 | 0.6 |
| Lipolase 100T | 0.1 | 0.2 | 0.2 | 0.3 |
| CAREZYME 5T | 0.1 | 0.2 | 0.2 | 0.3 |
| Sodium perborate | — | — | 3 | 5 |
| Nonanoyloxybenzenesulfonate | — | — | 2 | 3 |
| Photobleach[2] (ppm) | 0.005 | 0.01 | — | — |
| Photobleach[3] (ppm) | — | — | 0.008 | 0.01 |
| Minors/fillers | balance | balance | balance | balance |

[1]Soil release polymer according to U.S. Pat. No. 4,968,451 Scheibel et al.
[2]Photobleach silicon(IV) (1:3) ratio of phthalocyanine to naphthalocyanine-di[poly(ethylene glycol 350)methyl ether] according to Example 11.
[3]Photobleach according to silicon(IV) (1:3) ratio of phthalocyanine to naphthalocyanine-di(Neodol 23-6.5)methyl ether) according to Example 11.

EXAMPLES 17–20

| Ingredients | Weight % | | | |
|---|---|---|---|---|
| | 17 | 18 | 19 | 20 |
| $C_{12}$–$C_{14}$ alkyl sulfate | 6 | 6 | 8 | 7 |
| $C_{12}$–$C_{14}$ alkyl ethoxylate (EO 4.2) | 11 | 12 | 10 | 5 |
| Zeolite | 38 | 35 | 30 | 10 |
| Trisodium citrate | — | — | — | 2 |
| SKS-6 silicate builder | — | — | — | 10 |
| Acrylate/maleate copolymer | — | — | — | 4 |
| Sodium carbonate | 9 | 10 | 4 | 5 |
| EDTMP[1] | 0.2 | — | 0.3 | — |
| Ethylenediamine disuccinate | — | — | — | 0.4 |
| Sodium percarbonate | 8 | — | 10 | 25 |
| Nonanolyoxybenzene sulfonate | — | — | 3 | — |
| Tetraacetylethylenediamine | 7 | — | — | — |
| Savinase (4.0 KNPU/g) | 2 | 1.5 | 2 | 1.5 |
| Lipolase (100,000 LU/g) | 0.2 | 0.5 | 0.5 | — |
| Soap | 1 | — | — | — |
| Suds suppressor | 2 | 2 | 2 | 2 |
| Soil release agent[2] | 0.5 | — | 0.5 | — |
| Soil release agent[3] | 0.5 | 0.5 | — | 0.5 |
| Dispersent[4] | — | 2.5 | — | — |
| Photobleach[5] (ppm) | 0.005 | 0.01 | — | — |
| Photobleach[6] (ppm) | — | — | 0.008 | 0.01 |
| Minors/fillers | balance | balance | balance | balance |

[1]Ethylenediamine tetramethylenephosphonate
[2]Soil release polymer according to U.S. Pat. No. 5,415,807, Gosselink et al. issued May 16, 1995.
[3]Soil release polymer according to U.S. Pat. No. 4,702,857, Gosselink issued October 27, 1987.
[4]Hydrophobic soil dispersent according to U.S. Pat. No. 5,565,145, Watson et al. issued October 15, 1996.
[5]Photobleach according to Example 12
[6]Photobleach silicon(IV) (1:3) ratio of phthalocyanine to naphthalocyanine di-[glycerol-di-(diethyleneglycolmethyl ether)] according to Example 11.

EXAMPLE 21

| Ingredients | Weight % |
|---|---|
| $C_{12}$ Linear alkyl benzene sulphonate | 30 |
| Phosphate (as sodium tripolyphosphate) | 7 |
| Sodium carbonate | 15 |
| Sodium pyrophosphate | 7 |
| Coconut monoethanolamide | 2 |
| Zeolite A | 5 |
| Carboxymethylcellulose | 0.2 |
| Polyacrylate (m.w. 1400) | 0.2 |
| Sodium percarbonate | 15 |
| Protease | 0.3 |
| $CaSO_4$ | 1 |
| $MgSO_4$ | 1 |
| Photobleach[1] (ppm) | 0.01 |
| Minors/fillers | balance |

[1]Photobleach according to Example 12.

Low Aqueous Cleaning Composition

EXAMPLE 22

| Ingredients | Weight % |
|---|---|
| Photobleach[1] (ppm) | 0.005–1.5 |
| BPP[2] | 5–25 |
| 1,2-octanediol | 0.1–70 |
| Magnesium alkylethoxy (E1) sulfate | 0.01–0.8 |

-continued

| Ingredients | Weight % |
|---|---|
| Magnesium alkylethoxy (E6.5) sulfate | 0.01–0.8 |
| $C_{12}$ dimethylamine oxide | 0.01–0.8 |
| PEMULEN[3] | 0.05–0.2 |
| Perfume | 0.01–1.5 |
| Water | balance |

[1]Photobleach according to Example 11.
[2]Other co-solvents which can be used herein together with the BPP, MPP, EPP and PPP primary solvents include various glycol ethers, including materials marketed under trademarks such as Carbitol, methyl Carbitol, butyl Carbitol, propyl Carbitol, hexyl Cellosolve, and the like. If desired, and having due regard for safety and odor for in-home use, various conventional chlorinated and hydrocarbon dry cleaning solvents may also be used. Included among these are 1,2-dichloroethane, trichloroethylene, isoparaffins, and mixtures thereof.
[3]As disclosed in U.S. Pat. Nos. 4,758,641 and 5,004,557, such polyacrylates include homopolymers which may be crosslinked to varying degrees, as well as non-crosslinked. Preferred herein are homopolymers having a molecular weight in the range of from about 100,000 to about 10,000,000, preferably 2000,000 to 5,000,000.

For the materials disclosed in Example 29, excellent cleaning performance is secured using any non-immersion processes and articles to provide from about 5 g to about 50 g of the cleaning compositions per kilogram of fabric being cleaned. Use of the polyacrylate emulsifier at the indicated low levels minimizes residues on the fabrics.

Fabrics are laundered using the foregoing compositions, typically at usage concentrations of from about 10 ppm to about 10,000 ppm. The fabrics are dried in the presence of light, preferably natural sunlight, to achieve improved photobleaching benefits.

What is claimed is:

1. A hybrid metallocyanine photosensitizing mixture, the mixture comprising:

A) one or more hybrid compounds having the formula:

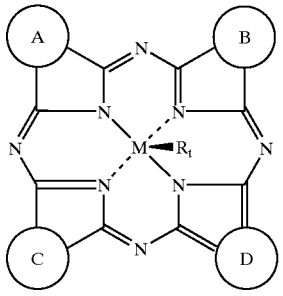

wherein each metallocyanine of the mixture comprises:

a) a photoactive metal or non-metal M wherein said photoactive metal or non-metal M is selected from the group consisting of silicon, germanium, tin, lead, aluminum, platinum, palladium, phosphorous, and mixtures thereof, provided said metal or non-metal has a valence of three or four, b) aromatic rings A, B, C, and D wherein each ring is independently selected from the group consisting of a) a benzene ring unit having the formula:
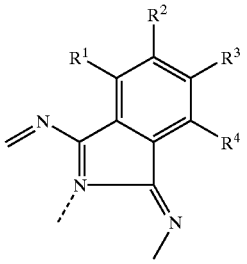
or
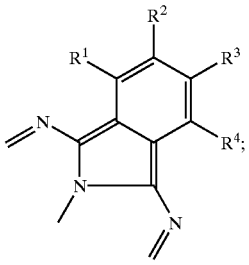
b) a 2,3-naphthylene ring unit having the formula:
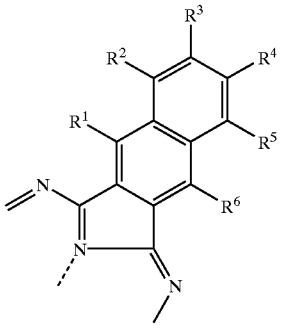
or
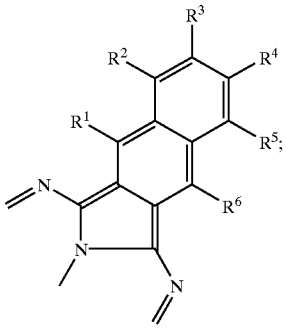
c) a 1,2-naphthylene ring unit having the formula:
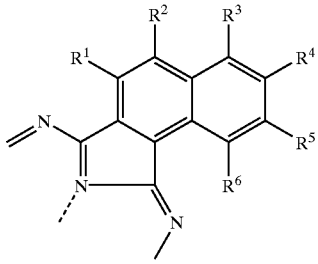
or
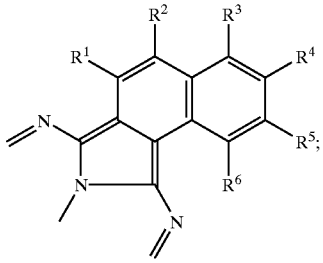
d) an anthracene ring unit having the formula:
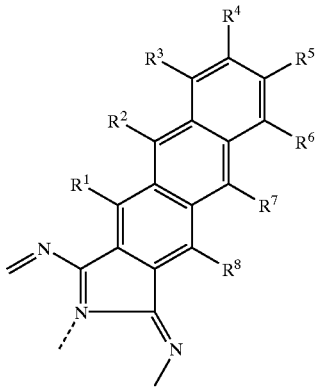
or
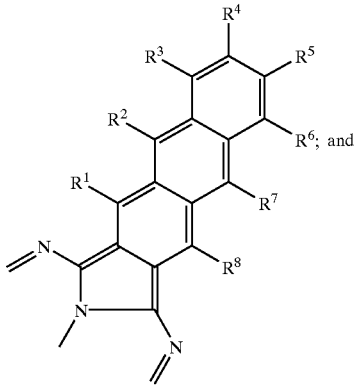

e) an phenanthrene ring unit having the formula:

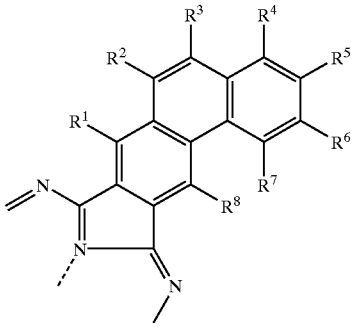

or

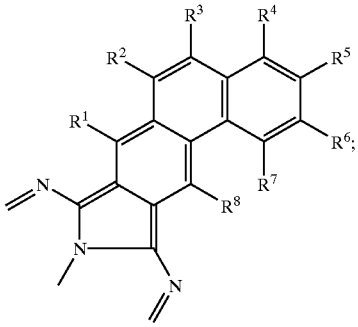

wherein each $R^1$, $R^2$, $R^3$, $R^4$, $R^5$, $R^6$, $R^7$, and $R^8$ unit is independently selected from the group consisting of:

a) hydrogen;

b) halogen;

c) hydroxy;

d) cyano;

e) nitrilo;

f) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

g) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

h) polyhydroxyl substituted $C_3$–$C_{22}$ alkyl;

i) $C_1$–$C_{22}$ alkoxy;

j) branched alkoxy having the formula

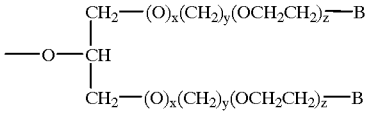

or

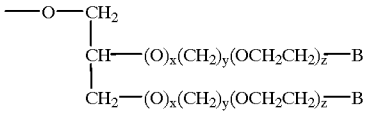

wherein B is hydrogen, hydroxyl, $C_1$–$C_{30}$ alkyl, $C_1$–$C_{30}$ alkoxy, —$CO_2H$, —$OCH_2CO_2H$, —$SO_3^-M^+$, —$OSO_3^-M^+$, —$PO_3^{2-}M$, —$OPO_3^{2-}M$, or mixtures thereof; M is a water soluble cation in sufficient amount to satisfy charge balance; x is 0 or 1, each y independently has the value from 0 to 6, each z independently has the value from 0 to 100;

k) substituted aryl, unsubstituted aryl, or mixtures thereof;

l) substituted alkylenearyl, unsubstituted alkylenearyl, or mixtures thereof;

m) substituted aryloxy, unsubstituted aryloxy, or mixtures thereof;

n) substituted oxyalkylenearyl, unsubstituted oxyalkylenearyl, or mixtures thereof;

o) substituted alkyleneoxyaryl, unsubstituted alkyleneoxyaryl, or mixtures thereof;

p) $C_1$–$C_{22}$ thioalkyl, $C_3$–$C_{22}$ branched thioalkyl, or mixtures thereof;

q) an ester of the formula —$CO_2R^{25}$ wherein $R^{25}$ is i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

iii) polyhydroxyl substituted $C_3$–$C_{22}$ alkylene;

iv) $C_3$–$C_{22}$ glycol;

v) $C_1$–$C_{22}$ alkoxy;

vi) $C_3$–$C_{22}$ branched alkoxy;

vii) substituted aryl, unsubstituted aryl, or mixtures thereof;

viii) substituted alkylenearyl, unsubstituted alkylenearyl, or mixtures thereof;

ix) substituted aryloxy, unsubstituted aryloxy, or mixtures thereof;

x) substituted oxyalkylenearyl, unsubstituted oxyalkylenearyl, or mixtures thereof;

xi) substituted alkyleneoxyaryl, unsubstituted alkyleneoxyaryl, or mixtures thereof;

r) an alkyleneamino unit of the formula

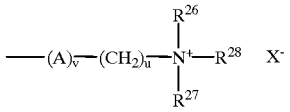

wherein $R^{26}$ and $R^{27}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

$R^{28}$ is:

i) hydrogen;

ii) $C_1$–$C_{22}$ alkyl, $C_3$–$C_{22}$ branched alkylene, $C_2$–$C_{22}$ alkenylene, $C_3$–$C_{22}$ branched alkenylene, or mixtures thereof;

A is nitrogen or oxygen; X is chlorine, bromine, iodine, or other water soluble anion, v is 0 or 1, u is from 0 to 22;

s) an amino unit of the formula $$—NR^{29}R^{30}$$

wherein $R^{29}$ and $R^{30}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

t) an alkylethyleneoxy unit of the formula $$—(A)_v—(CH_2)_y(OCH_2CH_2)_xZ$$

wherein Z is:

i) hydrogen;

ii) hydroxyl;

iii) —$CO_2H$;

iv) $—SO_3^-M^+$;
v) $—OSO_3^-M^+$;
vi) $C_1$–$C_6$ alkoxy;
vii) substituted aryl, unsubstituted aryl, or mixtures thereof;
viii) substituted aryloxy, unsubstituted aryloxy, or mixtures thereof;
ix) alkyleneamino; or mixtures thereof;
A is nitrogen or oxygen, M is a water soluble cation, v is 0 or 1, x is from 0 to 100, y is from 0 to 12;

u) substituted siloxy of the formula $$—OSiR^{31}R^{32}R^{33}$$

wherein each $R^{31}$, $R^{32}$, and $R^{33}$ is independently
i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;
ii) substituted aryl, unsubstituted aryl, or mixtures thereof;
iii) substituted aryloxy, unsubstituted aryloxy, or mixtures thereof;
iv) an alkylethyleneoxy unit of the formula $$—(A)_v—(CH_2)_y(OCH_2CH_2)_xZ$$

wherein Z is:
a) hydrogen;
b) hydroxyl;
c) $—CO_2H$;
d) $—SO_3^-M^+$;
e) $—OSO_3^-M^+$;
f) $C_1$–$C_6$ alkoxy;
g) substituted aryl, unsubstituted aryl, or mixtures thereof;
h) substituted aryloxy, unsubstituted aryloxy, or mixtures thereof;
i) alkyleneamino; or mixtures thereof;
A is nitrogen or oxygen, M is a water soluble cation, v is 0 or 1, x is from 0 to 100, y is from 0 to 12; or mixtures thereof; and further wherein if aromatic rings A, B, C and D are all benzene rings at the same time then each $R^1$, $R^2$, $R^3$ and $R^4$, on each of benzene rings A, B, C and D are independently selected from the group consisting of:

a) hydrogen;
b) halogen;
c) cyano;
d) nitrilo;
e) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;
f) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;
g) polyhydroxyl substituted $C_3$–$C_{22}$ alkyl;
h) substituted aryl, unsubstituted aryl, or mixtures thereof;
i) substituted alkylenearyl, unsubstituted alkylenearyl, or mixtures thereof;
j) substituted alkyleneoxyaryl, unsubstituted alkyleneoxyaryl, or mixtures thereof;
k) $C_1$–$C_{22}$ thioalkyl, $C_3$–$C_{22}$ branched thioalkyl, or mixtures thereof;
l) an ester of the formula $—CO_2R^{25}$ wherein $R^{25}$ is
i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;
ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;
iii) polyhydroxyl substituted $C_3$–$C_{22}$ alkylene;
iv) $C_3$–$C_{22}$ glycol;
v) $C_1$–$C_{22}$ alkoxy;
vi) $C_3$–$C_{22}$ branched alkoxy;
vii) substituted aryl, unsubstituted aryl, or mixtures thereof;
viii) substituted alkylenearyl, unsubstituted alkylenearyl, or mixtures thereof;
ix) substituted aryloxy, unsubstituted aryloxy, or mixtures thereof;
x) substituted oxyalkylenearyl, unsubstituted oxyalkylenearyl, or mixtures thereof;
xi) substituted alkyleneoxyaryl, unsubstituted alkyleneoxyaryl, or mixtures thereof;

m) an alkyleneamino unit of the formula

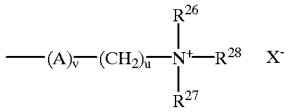

wherein
$R^{26}$ and $R^{27}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;
$R^{28}$ is:
i) hydrogen;
ii) $C_1$–$C_{22}$ alkyl, $C_3$–$C_{22}$ branched alkylene, $C_2$–$C_{22}$ alkenylene, $C_3$–$C_{22}$ branched alkenylene, or mixtures thereof;
A is nitrogen; X is chlorine, bromine, iodine, or other water soluble anion, v is 0 or 1, u is from 0 to 22;

n) an amino unit of the formula $$—NR^{29}R^3$$

wherein $R^{29}$ and $R^{30}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

o) an alkylethyleneoxy unit of the formula $$—(A)_v—(CH_2)_y(OCH_2CH_2)_xZ$$

wherein Z is:
i) hydrogen;
ii) hydroxyl;
iii) $—CO_2H$;
iv) $—SO_3^-M^+$;
v) $—OSO_3^-M^+$;
vi) $C_1$–$C_6$ alkoxy;
vii) substituted aryl, unsubstituted aryl, or mixtures thereof;
viii) substituted aryloxy, unsubstituted aryloxy, or mixtures thereof;
ix) alkyleneamino; or mixtures thereof;
A is nitrogen, M is a water soluble cation, v is 0 or 1, x is from 0 to 100, y is from 0 to 12;

c) solubility and substantivity mediating axial R units wherein each R unit is independently selected from the group consisting of:

a) hydrogen;
b) halogen;

c) hydroxy;

d) cyano;

e) nitrilo;

f) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

g) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

h) polyhydroxyl substituted $C_3$–$C_{22}$ alkyl;

i) $C_1$–$C_{22}$ alkoxy;

j) branched alkoxy having the formula:

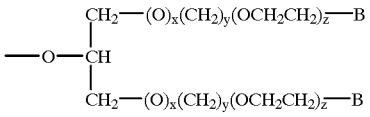

or

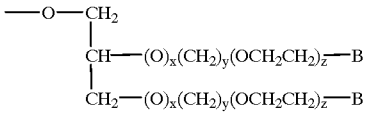

wherein B is hydrogen, hydroxyl, $C_1$–$C_{30}$ alkyl, $C_1$–$C_{30}$ alkoxy, —$CO_2H$, —$OCH_2CO_2H$, —$SO_3^-M^+$, —$OSO_3^-M^+$, —$PO_3^{2-}M$, —$OPO_3^{2-}M$, or mixtures thereof; M is a water soluble cation in sufficient amount to satisfy charge balance; x is 0 or 1, each y independently has the value from 0 to 6, each z independently has the value from 0 to 100;

k) substituted aryl, unsubstituted aryl, or mixtures thereof;

l) substituted alkylenearyl, unsubstituted alkylenearyl, or mixtures thereof;

m) substituted aryloxy, unsubstituted aryloxy, or mixtures thereof;

n) substituted oxyalkylenearyl, unsubstituted oxyalkylenearyl, or mixtures thereof;

o) substituted alkyleneoxyaryl, unsubstituted alkyleneoxyaryl, or mixtures thereof;

p) $C_1$–$C_{22}$ thioalkyl, $C_3$–$C_{22}$ branched thioalkyl, or mixtures thereof;

q) an alkyleneamino unit of the formula

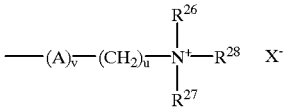

wherein $R^{26}$ and $R^{27}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

$R^{28}$ is:

i) hydrogen;

ii) $C_1$–$C_{22}$ alkyl, $C_3$–$C_{22}$ branched alkylene, $C_2$–$C_{22}$ alkenylene, $C_3$–$C_{22}$ branched alkenylene, or mixtures thereof;

A is nitrogen or oxygen; X is chlorine, bromine, iodine, or other water soluble anion, v is 0 or 1, u is from 0 to 22;

r) an amino unit of the formula $$—NR^{29}R^{30}$$

wherein $R^{29}$ and $R^{30}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

s) an alkylethyleneoxy unit of the formula $$—(A)_v—(CH_2)_y(OCH_2CH_2)_xZ$$

wherein Z is:

i) hydrogen;

ii) hydroxyl;

iii) —$CO_2H$;

iv) —$SO_3^-M^+$;

v) —$OS_3^-M^+$;

vi) $C_1$–$C_6$ alkoxy;

vii) substituted aryl, unsubstituted aryl, or mixtures thereof;

viii) substituted aryloxy, unsubstituted aryloxy, or mixtures thereof;

ix) alkyleneamino; or mixtures thereof;

A is nitrogen or oxygen, M is a water soluble cation, v is 0 or 1, x is from 0 to 100, y is from 0 to 12;

t) a carboxylate of the formula:

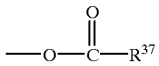

wherein $R^{37}$ is:

i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

iii) polyhydroxyl substituted $C_3$–$C_{22}$ alkylene;

iv) $C_3$–$C_{22}$ glycol;

v) $C_1$–$C_{22}$ alkoxy;

vi) $C_3$–$C_{22}$ branched alkoxy;

vii) substituted aryl, unsubstituted aryl, or mixtures thereof;

viii) substituted alkylenearyl, unsubstituted alkylenearyl, or mixtures thereof;

ix) substituted aryloxy, unsubstituted aryloxy, or mixtures thereof;

x) substituted oxyalkylenearyl, unsubstituted oxyalkylenearyl, or mixtures thereof;

xi) substituted alkyleneoxyaryl, unsubstituted alkyleneoxyaryl, or mixtures thereof;

u) substituted siloxy of the formula $$—OSiR^{31}R^{32}R^{33}$$

wherein each $R^{31}$, $R^{32}$, and $R^{33}$ is independently i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) substituted aryl, unsubstituted aryl, or mixtures thereof;

iii) substituted aryloxy, unsubstituted aryloxy, or mixtures thereof;

iv) an alkylethyleneoxy unit of the formula $$—(A)_v—(CH_2)_y(OCH_2CH_2)_xZ$$

wherein Z is:

a) hydrogen;

b) hydroxyl;
c) $—CO_2H$;
d) $—SO_3^-M^+$;
e) $—OSO_3^-M^+$;
f) $C_1$–$C_6$ alkoxy;
g) substituted aryl, unsubstituted aryl, or mixtures thereof;
h) substituted aryloxy, unsubstituted aryloxy, or mixtures thereof;
i) alkyleneamino; or mixtures thereof;

A is nitrogen or oxygen, M is a water soluble cation, v is 0 or 1, x is from 0 to 100, y is from 0 to 12;

v) units of the formula:

$$—Y_i—L_j \text{ or } —Y_i—Q_j$$

wherein Y is a linking moiety selected from the group consisting of O, $CR^{41}R^{42}$, $OSiR^{41}R^{42}$, $OSnR^{41}R^{42}$, and mixtures thereof; wherein $R^{41}$ and $R^{42}$ are hydrogen, $C_1$–$C_4$ alkyl, halogen, and mixtures thereof; i is 0 or 1, j is from 1 to 3; L is a ligand selected from the group consisting of:

a) $C_3$–$C_{30}$ linear alkyl, $C_3$–$C_{30}$ branched alkyl, $C_2$–$C_{30}$ linear alkenyl, $C_3$–$C_{30}$ branched alkenyl, $C_6$–$C_{20}$ aryl, $C_7$–$C_{20}$ arylalkyl, $C_7$–$C_{20}$ alkylaryl;

b) an alkylethyleneoxy unit of the formula $$—(R^{39})_y(OR^{38})_xOZ$$

wherein Z is hydrogen, $C_1$–$C_{20}$ alkyl, $C_3$–$C_{20}$ branched alkyl, $C_2$–$C_{20}$ linear alkenyl, $C_3$–$C_{20}$ branched alkenyl, $C_6$–$C_{20}$ aryl, $C_7$–$C_{30}$ arylalkyl, $C_6$–$C_{20}$ alkylaryl; $R^{38}$ is $C_1$–$C_4$ linear alkylene, $C_1$–$C_4$ branched alkylene, $C_3$–$C_6$ hydroxyalkylene, and mixtures thereof; $R^{39}$ is selected from the group consisting of $C_2$–$C_{20}$ alkylene, $C_6$–$C_{20}$ branched alkylene, $C_7$–$C_{20}$ arylene, $C_7$–$C_{30}$ arylalkylene, $C_7$–$C_{30}$ alkylarylene; x is from 1 to 100; y is 0 or 1; and c) mixtures thereof;

Q is an ionic moiety having the formula:

$$—R^{40}—P$$

wherein $R^{40}$ is selected from the group consisting of $C_3$–$C_{30}$ linear alkylene, $C_3$–$C_{30}$ branched alkylene, $C_2$–$C_{30}$ linear alkenylene, $C_3$–$C_{30}$ branched alkenylene, $C_6$–$C_{16}$ arylene, and mixtures thereof; P is selected from the group consisting of $—CO_2^-M^+$, $—SO_3^-M^{30}$, $—OSO_3^-M^{30}$; $PO_3^{2-}M^+$, $—OPO_3^-M^+$, $—N^+(R^{36})_3X^-$; $R^{36}$ is independently hydrogen, $C_1$–$C_6$ alkyl, $—(CH_2)_nOH$, $—(CH_2CH_2O)_nH$, and mixtures thereof; wherein n is from 1 to 4; M is a water soluble cation of sufficient charge to provide electronic neutrality and X is a water soluble anion;

or mixtures thereof; t has the value of 1 or 2;

provided each photosensitizer of said mixture has a Q-band maximum absorption wavelength of 600 nm or greater.

2. A compound according to claim 1 wherein said hydrophobic axial R unit is an alkylethyleneoxy unit of the formula $$—(R^{39})_y(OR^{38})_xOZ$$

wherein Z is selected from the group consisting of hydrogen, $C_3$–$C_{20}$ linear alkyl, $C_3$–$C_{20}$ branched alkyl, $C_2$–$C_{20}$ linear alkenyl, $C_3$–$C_{20}$ branched alkenyl, $C_6$–$C_{10}$ aryl, and mixtures thereof; $R^{38}$ is selected from the group consisting of $C_1$–$C_4$ linear alkylene, $C_1$–$C_4$ branched alkylene, and mixtures thereof; $R^{39}$ is selected from the group consisting of $C_1$–$C_6$ alkylene, $C_1$–$C_6$ branched alkylene, $C_6$–$C_{10}$ arylene, and mixtures thereof; x is from 1 to 50; y is 0 or 1.

3. A compound according to claim 2 wherein Z is hydrogen, $C_1$–$C_{20}$ alkyl, $C_3$–$C_{20}$ branched alkyl, $C_5$–$C_{20}$ aryl, $C_6$–$C_{20}$ arylalkyl, $C_6$–$C_{20}$ alkylaryl; $R^{38}$ is $C_{1-4}$ linear alkylene; y is 0.

4. A compound according to claim 3 wherein Z is hydrogen, $C_1$–$C_{20}$ alkyl, or $C_3$–$C_{20}$ branched alkyl.

5. A compound according to claim 4 wherein Z is hydrogen or methyl.

6. A compound according to claim 1 wherein $R^1$–$R^8$ is hydrogen, halogen, $C_1$–$C_{22}$ alkoxy, and mixtures thereof.

7. A compound according to claim 6 wherein $R^1$–$R^8$ is hydrogen, bromine, iodine, methoxy, and mixtures thereof.

8. A photobleaching composition comprising:

A) at least about 0.001 ppm, of a hybrid metallocyanine photosensitizing mixture, the mixture comprising two or more hybrid compounds having the formula:

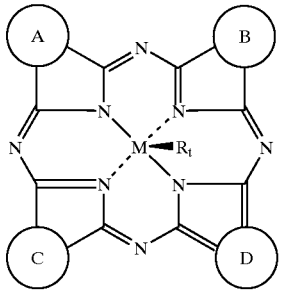

wherein each metallocyanine of the mixture comprises:

a) a photoactive metal or non-metal M wherein said photoactive metal or non-metal M is selected from the group consisting of silicon, germanium, tin, lead, aluminum, platinum, palladium, phosphorous, and mixtures thereof, provided said metal or non-metal has a valence of three or four;

b) aromatic rings A, B, C, and D wherein each ring is independently selected from the group consisting of a) a benzene ring unit having the formula:

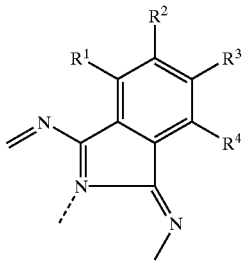

or

-continued
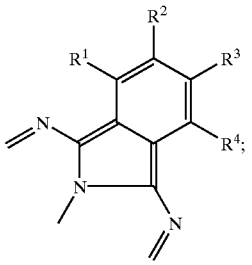
b) a 2,3-naphthylene ring unit having the formula:
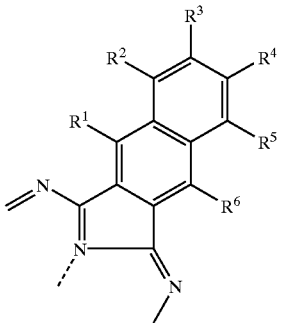
or
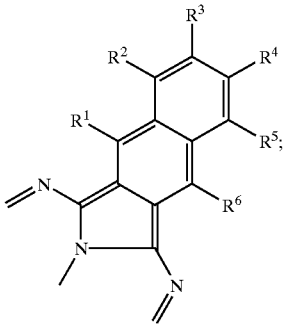
c) a 1,2-naphthylene ring unit having the formula:
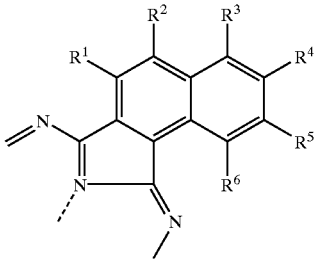
or
-continued
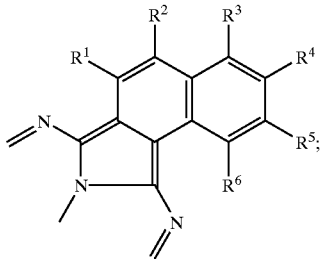
d) an anthracene ring unit having the formula:
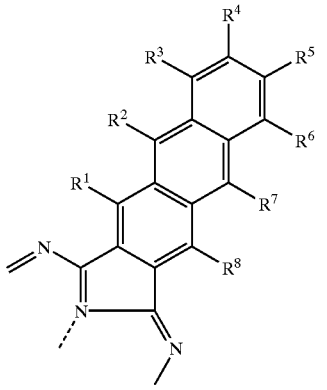
or
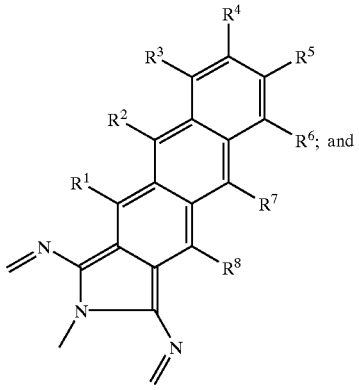
e) an phenanthrene ring unit having the formula:
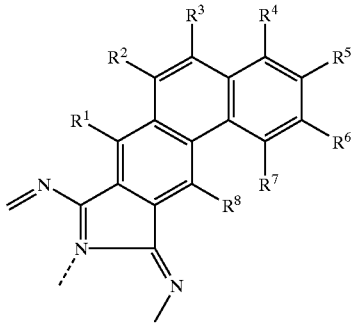
or -continued

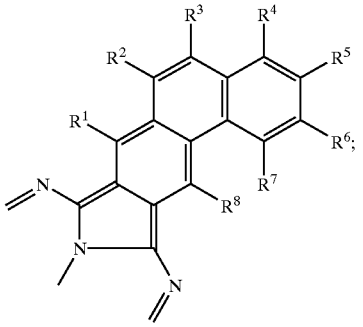

wherein each $R^1$, $R^2$, $R^3$, $R^4$, $R^5$, $R^6$, $R^7$, and $R^8$ unit is independently selected from the group consisting of:

a) hydrogen;

b) halogen;

c) hydroxy;

d) cyano;

e) nitrilo;

f) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

g) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

h) polyhydroxyl substituted $C_3$–$C_{22}$ alkyl;

i) $C_1$–$C_{22}$ alkoxy;

j) branched alkoxy having the formula

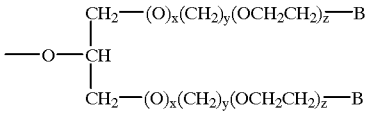

or

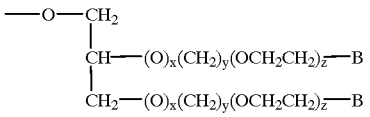

wherein B is hydrogen, hydroxyl, $C_1$–$C_{30}$ alkyl, $C_1$–$C_{30}$ alkoxy, $—CO_2H$, $—OCH_2CO_2H$, $—SO_3^-M^+$, $—OSO_3^-M^+$, $—PO_3^{2-}M$, $—OPO_3^{2-}M$, or mixtures thereof, M is a water soluble cation in sufficient amount to satisfy charge balance; x is 0 or 1, each y independently has the value from 0 to 6, each z independently has the value from 0 to 100;

k) substituted aryl, unsubstituted aryl, or mixtures thereof;

l) substituted alkylenearyl, unsubstituted alkylenearyl, or mixtures thereof;

m) substituted aryloxy, unsubstituted aryloxy, or mixtures thereof;

n) substituted oxyalkylenearyl, unsubstituted oxyalkylenearyl, or mixtures thereof;

o) substituted alkyleneoxyaryl, unsubstituted alkyleneoxyaryl, or mixtures thereof;

p) $C_1$–$C_{22}$ thioalkyl, $C_3$–$C_{22}$ branched thioalkyl, or mixtures thereof;

q) an ester of the formula $—CO_2R^{25}$ wherein $R^{25}$ is i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

iii) polyhydroxyl substituted $C_3$–$C_{22}$ alkylene;

iv) $C_3$–$C_{22}$ glycol;

v) $C_1$–$C_{22}$ alkoxy;

vi) $C_3$–$C_{22}$ branched alkoxy;

vii) substituted aryl, unsubstituted aryl, or mixtures thereof;

viii) substituted alkylenearyl, unsubstituted alkylenearyl, or mixtures thereof;

ix) substituted aryloxy, unsubstituted aryloxy, or mixtures thereof;

x) substituted oxyalkylenearyl, unsubstituted oxyalkylenearyl, or mixtures thereof;

xi) substituted alkyleneoxyaryl, unsubstituted alkyleneoxyaryl, or mixtures thereof;

r) an alkyleneamino unit of the formula

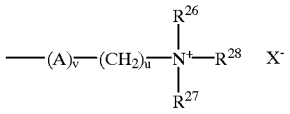

wherein $R^{26}$ and $R^{27}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

$R^{28}$ is:

i) hydrogen;

ii) $C_1$–$C_{22}$ alkyl, $C_3$–$C_{22}$ branched alkylene, $C_2$–$C_{22}$ alkenylene, $C_3$–$C_{22}$ branched alkenylene, or mixtures thereof;

A is nitrogen or oxygen; X is chlorine, bromine, iodine, or other water soluble anion, v is 0 or 1, u is from 0 to 22;

s) an amino unit of the formula $$—NR^{29}R^{30}$$

wherein $R^{29}$ and $R^{30}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

t) an alkylethyleneoxy unit of the formula $$—(A)_v—(CH_2)_y(OCH_2CH_2)_xZ$$

wherein Z is:

i) hydrogen;

ii) hydroxyl;

iii) $—CO_2H$;

iv) $—SO_3^-M^+$;

v) $—OSO_3^-M^+$;

vi) $C_1$–$C_6$ alkoxy;

vii) substituted aryl, unsubstituted aryl, or mixtures thereof;

viii) substituted aryloxy, unsubstituted aryloxy, or mixtures thereof;

ix) alkyleneamino; or mixtures thereof;

A is nitrogen or oxygen, M is a water soluble cation, v is 0 or 1, x is from 0 to 100, y is from 0 to 12;

u) substituted siloxy of the formula $$—OSiR^{31}R^{32}R^{33}$$

wherein each $R^{31}$, $R^{32}$, and $R^{33}$ is independently i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) substituted aryl, unsubstituted aryl, or mixtures thereof;

iii) substituted aryloxy, unsubstituted aryloxy, or mixtures thereof;

iv) an alkylethyleneoxy unit of the formula $$—(A)_v—(CH_2)_y(OCH_2CH_2)_xZ$$

wherein Z is:

a) hydrogen;

b) hydroxyl;

c) $—CO_2H$;

d) $—SO_3^-M^+$;

e) $—OSO_3^-M^+$;

f) $C_1$–$C_6$ alkoxy;

g) substituted aryl, unsubstituted aryl, or mixtures thereof;

h) substituted aryloxy, unsubstituted aryloxy, or mixtures thereof;

i) alkyleneamino; or mixtures thereof;

A is nitrogen or oxygen, M is a water soluble cation, v is 0 or 1, x is from 0 to 100, y is from 0 to 12; or mixtures thereof; and further wherein if aromatic rings A, B, C and D are all benzene rings at the same time then each $R^1$, $R^2$, $R^3$ and $R^4$, on each of benzene rings A, B, C and D are independently selected from the group consisting of:

a) hydrogen;

b) halogen;

c) cyano;

d) nitrilo;

e) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

f) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

g) polyhydroxyl substituted $C_3$–$C_{22}$ alkyl;

h) substituted aryl, unsubstituted aryl, or mixtures thereof;

i) substituted alkylenearyl, unsubstituted alkylenearyl, or mixtures thereof;

j) substituted alkyleneoxyaryl, unsubstituted alkyleneoxyaryl, or mixtures thereof;

k) $C_1$–$C_{22}$ thioalkyl, $C_3$–$C_{22}$ branched thioalkyl, or mixtures thereof;

l) an ester of the formula $—CO_2R^{25}$ wherein $R^{25}$ is i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

iii) polyhydroxyl substituted $C_3$–$C_{22}$ alkylene;

iv) $C_3$–$C_{22}$ glycol;

v) $C_1$–$C_{22}$ alkoxy;

vi) $C_3$–$C_{22}$ branched alkoxy;

vii) substituted aryl, unsubstituted aryl, or mixtures thereof;

viii) substituted alkylenearyl, unsubstituted alkylenearyl, or mixtures thereof;

ix) substituted aryloxy, unsubstituted aryloxy, or mixtures thereof;

x) substituted oxyalkylenearyl, unsubstituted oxyalkylenearyl, or mixtures thereof;

xi) substituted alkyleneoxyaryl, unsubstituted alkyleneoxyaryl, or mixtures thereof;

m) an alkyleneamino unit of the formula

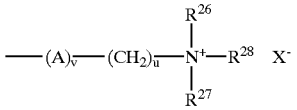

wherein $R^{26}$ and $R^{27}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

$R^{28}$ is:

i) hydrogen;

ii) $C_1$–$C_{22}$ alkyl, $C_3$–$C_{22}$ branched alkylene, $C_2$–$C_{22}$ alkenylene, $C_3$–$C_{22}$ branched alkenylene, or mixtures thereof;

A is nitrogen; X is chlorine, bromine, iodine, or other water soluble anion, v is 0 or 1, u is from 0 to 22;

n) an amino unit of the formula $$—NR^{29}R^{30}$$

wherein $R^{29}$ and $R^{30}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

o) an alkylethyleneoxy unit of the formula $$—(A)_v—(CH_2)_y(OCH_2CH_2)_xZ$$

wherein Z is:

i) hydrogen;

ii) hydroxyl;

iii) $—CO_2H$;

iv) $—SO_3^-M^+$;

v) $—OSO_3^-M^+$;

vi) $C_1$–$C_6$ alkoxy;

vii) substituted aryl, unsubstituted aryl, or mixtures thereof;

viii) substituted aryloxy, unsubstituted aryloxy, or mixtures thereof;

ix) alkyleneamino; or mixtures thereof;

A is nitrogen, M is a water soluble cation, v is 0 or 1, x is from 0 to 100, y is from 0 to 12;

c) solubility and substantivity mediating axial R units wherein each R unit is independently selected from the group consisting of:

a) hydrogen;

b) halogen;

c) hydroxy;

d) cyano;

e) nitrilo;

f) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

g) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

h) polyhydroxyl substituted $C_3$–$C_{22}$ alkyl;

i) $C_1$–$C_{22}$ alkoxy;

j) branched alkoxy having the formula:

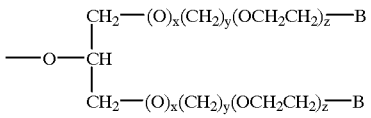

or

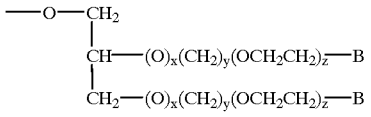

wherein B is hydrogen, hydroxyl, $C_1$–$C_{30}$ alkyl, $C_1$–$C_{30}$ alkoxy, —$CO_2H$, —$OCH_2CO_2H$, —$SO_3^-M^+$, —$OSO_3^-M^+$, —$PO_3^{2-}M$, —$OPO_3^{2-}M$, or mixtures thereof; M is a water soluble cation in sufficient amount to satisfy charge balance; x is 0 or 1, each y independently has the value from 0 to 6, each z independently has the value from 0 to 100;

k) substituted aryl, unsubstituted aryl, or mixtures thereof;

l) substituted alkylenearyl, unsubstituted alkylenearyl, or mixtures thereof;

m) substituted aryloxy, unsubstituted aryloxy, or mixtures thereof;

n) substituted oxyalkylenearyl, unsubstituted oxyalkylenearyl, or mixtures thereof;

o) substituted alkyleneoxyaryl, unsubstituted alkyleneoxyaryl, or mixtures thereof;

p) $C_1$–$C_{22}$ thioalkyl, $C_3$–$C_{22}$ branched thioalkyl, or mixtures thereof;

q) an alkyleneamino unit of the formula

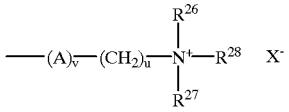

wherein $R^{26}$ and $R^{27}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

$R^{28}$ is:

i) hydrogen;

ii) $C_1$–$C_{22}$ alkyl, $C_3$–$C_{22}$ branched alkylene, $C_2$–$C_{22}$ alkenylene, $C_3$–$C_{22}$ branched alkenylene, or mixtures thereof;

A is nitrogen or oxygen; X is chlorine, bromine, iodine, or other water soluble anion, v is 0 or 1, u is from 0 to 22;

r) an amino unit of the formula $$—NR^{29}R^{30}$$

wherein $R^{29}$ and $R^{30}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

s) an alkylethyleneoxy unit of the formula $$—(A)_v—(CH_2)_y(OCH_2CH_2)_xZ$$

wherein Z is:

i) hydrogen;

ii) hydroxyl;

iii) —$CO_2H$;

iv) —$SO_3^-M^+$;

v) —$OS_3^-M^+$;

vi) $C_1$–$C_6$ alkoxy;

vii) substituted aryl, unsubstituted aryl, or mixtures thereof;

viii) substituted aryloxy, unsubstituted aryloxy, or mixtures thereof;

ix) alkyleneamino; or mixtures thereof;

A is nitrogen or oxygen, M is a water soluble cation, v is 0 or 1, x is from 0 to 100, y is from 0 to 12;

t) a carboxylate of the formula:

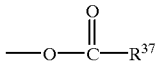

wherein $R^{37}$ is:

i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

iii) polyhydroxyl substituted $C_3$–$C_{22}$ alkylene;

iv) $C_3$–$C_{22}$ glycol;

v) $C_1$–$C_{22}$ alkoxy;

vi) $C_3$–$C_{22}$ branched alkoxy;

vii) substituted aryl, unsubstituted aryl, or mixtures thereof;

viii) substituted alkylenearyl, unsubstituted alkylenearyl, or mixtures thereof;

ix) substituted aryloxy, unsubstituted aryloxy, or mixtures thereof;

x) substituted oxyalkylenearyl, unsubstituted oxyalkylenearyl, or mixtures thereof;

xi) substituted alkyleneoxyaryl, unsubstituted alkyleneoxyaryl, or mixtures thereof;

u) substituted siloxy of the formula $$—OSiR^{31}R^{32}R^{33}$$

wherein each $R^{31}$, $R^{32}$, and $R^{33}$ is independently i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) substituted aryl, unsubstituted aryl, or mixtures thereof;

iii) substituted aryloxy, unsubstituted aryloxy, or mixtures thereof;

iv) an alkylethyleneoxy unit of the formula $$—(A)_v—(CH_2)_y(OCH_2CH_2)_xZ$$

wherein Z is:

a) hydrogen;

b) hydroxyl;

c) —$CO_2H$;

d) —$SO_3^-M^+$;

e) —$OSO_3^-M^+$;

f) $C_1$–$C_6$ alkoxy;

g) substituted aryl, unsubstituted aryl, or mixtures thereof;

h) substituted aryloxy, unsubstituted aryloxy, or mixtures thereof;

ii) alkyleneamino; or mixtures thereof;

A is nitrogen or oxygen, M is a water soluble cation, v is 0 or 1, x is from 0 to 100, y is from 0 to 12;

vi) units of the formula:

$$—Y_t—L_j \text{ or } —Y_t—Q_j$$

wherein

Y is a linking moiety selected from the group consisting of O, $CR^{41}R^{42}$, $OSiR^{41}R^{42}$, $OSnR^{41}R^{42}$, and mixtures thereof; wherein $R^{41}$ and $R^{42}$ are hydrogen, $C_1$–$C_4$ alkyl, halogen, and mixtures thereof; i is 0 or 1, j is from 1 to 3;

L is a ligand selected from the group consisting of:

a) $C_3$–$C_{30}$ linear alkyl, $C_3$–$C_{30}$ branched alkyl, $C_2$–$C_{30}$ linear alkenyl, $C_3$–$C_{30}$ branched alkenyl, $C_6$–$C_{20}$ aryl, $C_7$–$C_{20}$ arylalkyl, $C_7$–$C_{20}$ alkylaryl;

b) an alkylethyleneoxy unit of the formula $$—(R^{39})_y(OR^{38})_xOZ$$

wherein Z is hydrogen, $C_1$–$C_{20}$ alkyl, $C_3$–$C_{20}$ branched alkyl, $C_2$–$C_{20}$ linear alkenyl, $C_3$–$C_{20}$ branched alkenyl, $C_6$–$C_{20}$ aryl, $C_7$–$C_{30}$ arylalkyl, $C_6$–$C_{20}$ alkylaryl; $R^{38}$ is $C_1$–$C_4$ linear alkylene, $C_1$–$C_4$ branched alkylene, $C_3$–$C_6$ hydroxyalkylene, and mixtures thereof; $R^{39}$ is selected from the group consisting of $C_2$–$C_{20}$ alkylene, $C_6$–$C_{20}$ branched alkylene, $C_7$–$C_{20}$ arylene, $C_7$–$C_{30}$ arylalkylene, $C_7$–$C_{30}$ alkylarylene; x is from 1 to 100; y is 0 or 1; and c) mixtures thereof;

Q is an ionic moiety having the formula:

$$—R^{40}—P$$

wherein $R^{40}$ is selected from the group consisting of $C_3$–$C_{30}$ linear alkylene, $C_3$–$C_{30}$ branched alkylene, $C_2$–$C_{30}$ linear alkenylene, $C_3$–$C_{30}$ branched alkenylene, $C_6$–$C_{16}$ arylene, and mixtures thereof; P is selected from the group consisting of $—CO_2^-M^+$, $—SO_3^-M^+$, $—OSO_3^-M^+$; $PO_3^{2-}M^+$, $—OPO_3^-M^+$, $—N^+(R^{36})_3X^-$; $R^{36}$ is independently hydrogen, $C_1$–$C_6$ alkyl, $—(CH_2)_nOH$, $—(CH_2CH_2O)_nH$, and mixtures thereof; wherein n is from 1 to 4; M is a water soluble cation of sufficient charge to provide electronic neutrality and X is a water soluble anion;

or mixtures thereof; t has the value of 1 or 2;

provided each photosensitizer of said mixture has a Q-band maximum absorption wavelength of 600 nm or greater;

B) at least about 0.1% by weight of a detersive surfactant, said detersive surfactant is selected from the group consisting of anionic, cationic, nonionic, zwitterionic, ampholytic surfactants, and mixtures thereof; and C) the balance carriers and other adjunct ingredients said adjunct ingredients are selected from the group consisting of buffers, builders, chelants, filler salts, soil release agents, dispersants, enzymes, enzyme boosters, perfumes, thickeners, clays, bleaches, solvents, and mixtures thereof.

9. A composition according to claim 8 comprising from about 0.0 1 to about 10000 ppm of said hybrid metallocyanine photosensitizing mixture.

10. A composition according to claim 9 comprising from about 0.1 to about 5000 ppm of said hybrid metallocyanine photosensitizing mixture.

11. A composition according to claim 9 comprising from about 10 to about 1000 ppm of said hybrid metallocyanine photosensitizing mixture.

12. A composition according to claim 8 wherein said hybrid metallocyanine photosensitizing mixture comprises from about 3 to about 100 hybrid compounds.

13. A composition according to claim 12 wherein said hybrid metallocyanine photosensitizing mixture comprises from about 10 to about 100 hybrid compounds.

14. A composition according to claim 8 comprising from about 0.1% to about 30% by weight, of said detersive surfactant.

15. A composition according to claim 14 comprising from about 1% to about 30% by weight, of said detersive surfactant.

16. A composition according to claim 15 comprising from about 5% to about 20% by weight, of said detersive surfactant.

17. A composition according to claim 8 wherein said hydrophobic axial R unit is an alkylethyleneoxy unit of the formula $$—(R^{39})_y(R^{38})_xOZ$$

wherein Z is selected from the group consisting of hydrogen, $C_3$–$C_{20}$ linear alkyl, $C_3$–$C_{20}$ branched alkyl, $C_2$–$C_{20}$ linear alkenyl, $C_3$–$C_{20}$ branched alkenyl, $C_6$–$C_{10}$ aryl, and mixtures thereof; $R^{38}$ is selected from the group consisting of $C_1$–$C_4$ linear alkylene; $C_1$–$C_4$ branched alkylene, and mixtures thereof; $R^{39}$ is selected from the group consisting of $C_1$–$C_6$ alkylene, $C_1$–$C_6$ branched alkylene, $C_6$–$C_{10}$ arylene, and mixtures thereof; x is from 1 to 50; y is 0 or 1.

18. A composition according to claim 8 wherein $R^1$–$R^8$ is hydrogen, halogen, $C_1$–$C_{22}$ alkoxy, and mixtures thereof.

* * * * *